US011807488B2

(12) United States Patent
Zaitsu

(10) Patent No.: US 11,807,488 B2
(45) Date of Patent: Nov. 7, 2023

(54) SHEET CONVEYANCE GUIDE, SHEET CONVEYING DEVICE INCORPORATING THE SHEET CONVEYANCE GUIDE, AND IMAGE FORMING APPARATUS INCORPORATING THE SHEET CONVEYING DEVICE

(71) Applicant: Daikai Zaitsu, Kanagawa (JP)

(72) Inventor: Daikai Zaitsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 17/162,445

(22) Filed: Jan. 29, 2021

(65) Prior Publication Data

US 2021/0253386 A1 Aug. 19, 2021

(30) Foreign Application Priority Data

Feb. 14, 2020 (JP) ..... 2020-023685

(51) Int. Cl.
*B65H 5/36* (2006.01)
*B65H 5/06* (2006.01)
*B65H 3/06* (2006.01)

(52) U.S. Cl.
CPC ..... *B65H 5/36* (2013.01); *B65H 3/0669* (2013.01); *B65H 5/062* (2013.01); *B65H 2402/60* (2013.01); *B65H 2407/20* (2013.01); *B65H 2601/324* (2013.01)

(58) Field of Classification Search
CPC .... B65H 3/0669; B65H 3/06; B65H 2402/60; B65H 2407/20; B65H 2601/324
See application file for complete search history.

(56) References Cited

U.S. PATENT DOCUMENTS

| | | | | |
|---|---|---|---|---|
| 8,079,586 | B2 * | 12/2011 | Watanabe | B65H 3/0638 271/145 |
| 9,434,564 | B2 * | 9/2016 | Yokoyama | B65H 3/5207 |
| 10,040,652 | B2 * | 8/2018 | Fujita | B65H 3/0638 |
| 10,486,922 | B2 * | 11/2019 | Horita | B65H 3/0684 |
| 10,584,006 | B2 * | 3/2020 | Suzuki | B65H 5/062 |
| 11,091,334 | B2 * | 8/2021 | Aono | B65H 27/00 |
| 11,267,666 | B2 * | 3/2022 | Horita | F16D 1/101 |
| 2015/0097334 | A1 * | 4/2015 | Sekiguchi | B65H 3/0638 271/275 |
| 2017/0255155 | A1 | 9/2017 | Enomoto et al. | |
| 2019/0166260 | A1 | 5/2019 | Zaitsu | |
| 2019/0283990 | A1 | 9/2019 | Zaitsu et al. | |

(Continued)

FOREIGN PATENT DOCUMENTS

JP 2019-094211 6/2019

*Primary Examiner* — Patrick Cicchino
(74) *Attorney, Agent, or Firm* — Harness, Dickey & Pierce, P.L.C.

(57) ABSTRACT

A sheet conveyance guide includes a guide portion, a first thrust direction retainer, and a second thrust direction retainer. The guide portion is configured to guide a sheet. The first thrust direction retainer includes a first engagement portion configured to engage with a shaft of a sheet conveying roller configured to convey the sheet, and a guide releaser configured to be operated by a user to release engagement of the first engagement portion with the shaft of the sheet conveying roller. The second thrust direction retainer includes a second engagement portion configured to engage with the shaft of the sheet conveying roller.

16 Claims, 13 Drawing Sheets

(56) References Cited

U.S. PATENT DOCUMENTS

| | | | | |
|---|---|---|---|---|
| 2020/0041946 | A1* | 2/2020 | Sekigawa | G03G 15/65 |
| 2020/0165086 | A1 | 5/2020 | Zaitsu et al. | |
| 2021/0300697 | A1* | 9/2021 | Umeda | B65H 5/06 |

* cited by examiner

SHEET CONVEYANCE GUIDE, SHEET CONVEYING DEVICE INCORPORATING THE SHEET CONVEYANCE GUIDE, AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2020-023685, filed on Feb. 14, 2020, in the Japan Patent Office, the entire disclosure of which is hereby incorporated by reference herein.

BACKGROUND

Technical Field

Embodiments of the present disclosure relate to a sheet conveying device, a sheet conveying device incorporating the sheet conveyance guide, and an image forming apparatus incorporating the sheet conveying device.

Background Art

Various types of sheet conveyance guides are known to include a guide portion and a first thrust direction retainer. The guide portion guides a sheet. The first thrust direction retainer includes a first engagement portion and an operation unit. The first engagement portion engages with the shaft of a sheet conveying roller that conveys the sheet, from the thrust direction. The operation unit cancels the engagement of the shaft of the first engagement portion with the shaft of the sheet conveying roller due to the manual operation by a user.

However, if a user touched the operation unit unintentionally during the paper jam handling, it was likely to cancel the engagement of the shaft of the first engagement portion, causing the sheet conveyance guide to come off from the shaft of the sheet conveying roller.

SUMMARY

At least one aspect of this disclosure, a novel sheet conveyance guide includes a guide portion, a first thrust direction retainer, and a second thrust direction retainer. The guide portion is configured to guide a sheet. The first thrust direction retainer includes a first engagement portion configured to engage with a shaft of a sheet conveying roller configured to convey the sheet, and a guide releaser configured to be operated by a user to release engagement of the first engagement portion with the shaft of the sheet conveying roller. The second thrust direction retainer includes a second engagement portion configured to engage with the shaft of the sheet conveying roller.

Further, at least one aspect of this disclosure, a sheet conveying device includes the above-described sheet conveyance guide configured to guide a sheet, and a sheet conveying roller configured to convey the sheet.

Further, at least one aspect of this disclosure, an image forming apparatus includes the above-described sheet conveying device configured to convey a sheet, and an image forming device configured to form an image on the sheet conveyed by the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
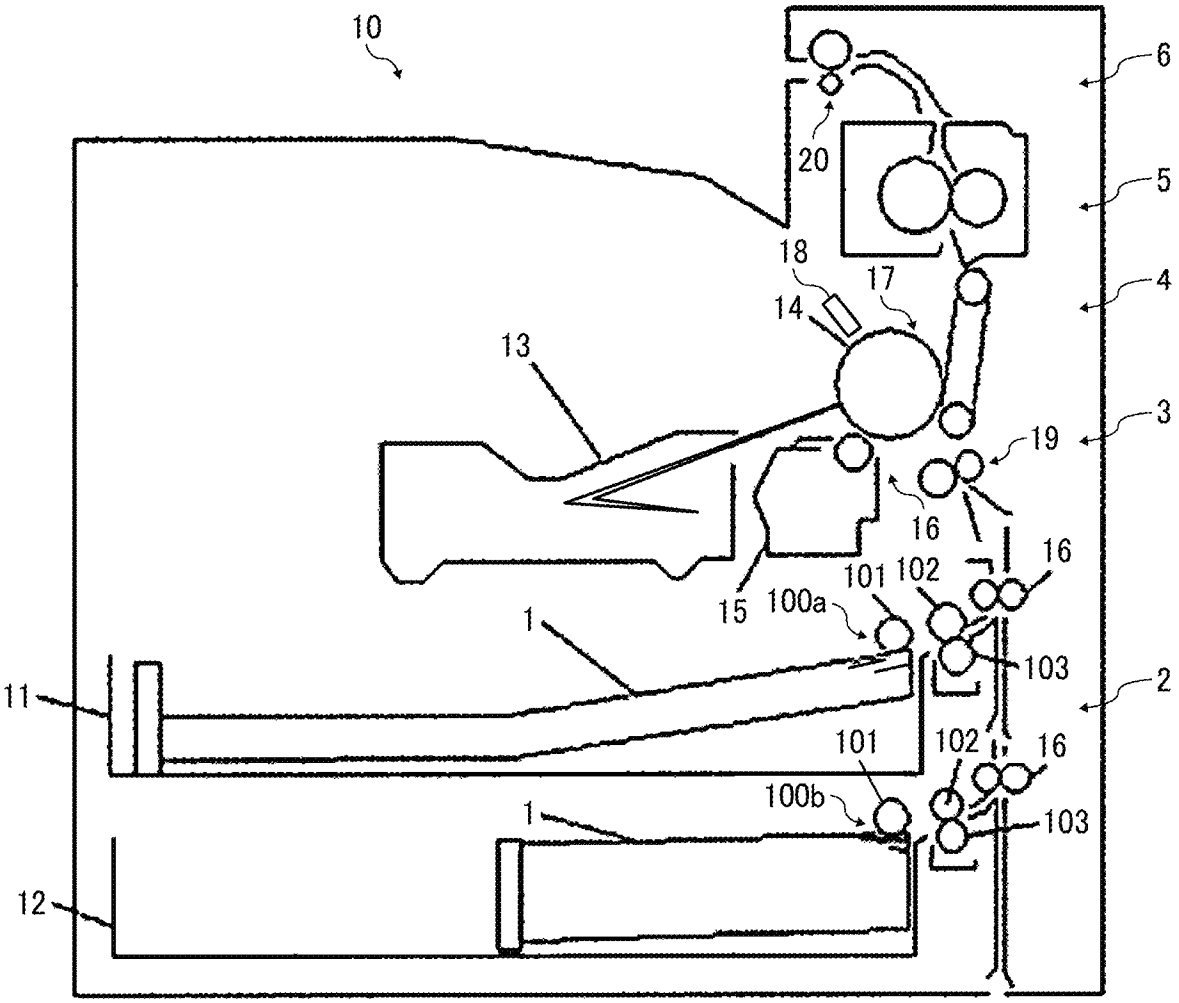
FIG. 1 is a diagram illustrating an image forming apparatus that includes a sheet conveying device including a sheet conveyance guide according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a sheet feeding device and an image forming apparatus incorporating the sheet feeding device, with reference to the following figures. It is to be noted that, in the present embodiment, identical parts are given identical reference numerals and redundant descriptions are summarized or omitted accordingly. In order to help understand the configuration, the drawings are partially omitted or illustrated in a schematic diagram.

FIG. 1 is a schematic diagram illustrating an image forming apparatus that includes a sheet conveying device including a sheet conveyance guide according to an embodiment of the present disclosure.

The image forming apparatus illustrated in FIG. 1 is a printer capable of printing a monochrome image. The image forming apparatus according to an embodiment of the present disclosure is not limited to a monochrome printer but may be a color printer capable of printing a color image. Further, the image forming apparatus according to an embodiment of the present disclosure is not limited to a printer but may be a copier that copies an original document and forms an image based on the copied image of the original document, a facsimile machine that is a communication unit, or a multifunction device having two or more functions of the printer, the copier, and the facsimile machine.

The image forming apparatus 10 illustrated in FIG. 1 is an electrophotographic printer in which forms an image (toner image) and transfers the image onto a sheet 1, by electrophotography. As illustrated in FIG. 1, the image forming apparatus 10 includes, e.g., a sheet feeding device 2, sheet conveying devices 100*a* and 100*b*, an image forming device 3, a transfer device 4, a fixing device 5, and a sheet ejection device 6.

The sheet feeding device 2 includes sheet trays 11 and 12, each functioning as a sheet loader to load the sheet 1. The sheet conveying devices 100*a* and 100*b* feed and convey the sheet 1 from the sheet trays 11 and 12, respectively. The image forming device 3 forms an image to be transferred onto the sheet 1. The transfer device 4 transfers the toner image formed by the image forming device 3. The fixing device 5 fixes the toner image transferred by the transfer device 4 onto the sheet 1, to the sheet 1. The sheet ejection device 6 ejects the sheet 1 to which the toner image is fixed.

As illustrated in FIG. 1, the image forming device 3 includes an optical writing unit 13, a drum-shaped photoconductor 14 that functions as an image bearer, a developing unit 15, and a cleaning unit 18. The optical writing unit 13 emits exposure light to the photoconductor 14, so that a latent image is formed on the surface of the photoconductor 14 that is uniformly charged by the optical writing unit 13. The developing unit 15 supplies toner that functions as developer, to the latent image formed on the photoconductor 14, so as to develop the latent image to a visible toner image. The cleaning unit 18 cleans the photoconductor 14 after transfer of the toner image.

The transfer device 4 includes a belt transfer unit 17 that is disposed facing the photoconductor 14. The photoconductor 14 and the belt transfer unit 17 are disposed in contact with each other, so that a transfer nip region is formed between the belt transfer unit 17 and the photoconductor 14. The sheet 1 fed from the sheet feeding device 2 is conveyed by a plurality of pairs of sheet conveying rollers 16 disposed along respective sheet conveyance passages, toward the transfer device 4. When the sheet 1 is conveyed to the transfer device 4, the toner image formed on the photoconductor 14 is transferred onto the sheet 1. Then, as the belt transfer unit 17 moves, the sheet 1 is conveyed to the fixing device 5. When the sheet 1 is conveyed to the fixing device 5, the fixing device 5 fixes the (toner) image to the sheet 1. Then, a pair of sheet ejection rollers 20 that is disposed between the fixing device 5 and the sheet ejection device 6 conveys the sheet 1 to the sheet ejection device 6, so that the sheet 1 is ejected to the outside of the image forming apparatus 10.

Next, a description is given of the configuration of each of the sheet conveying devices 100*a* and 100*b*. In the present embodiment, the sheet feeding device 2 includes two sheet trays, i.e., the sheet trays 11 and 12, and therefore includes the sheet conveying devices 100*a* and 100*b*, respectively, so that the sheet 1 is fed from each of the sheet trays 11 and 12. In a case in which the sheet feeding device 2 includes a single sheet tray, there may be a single sheet conveying device in the sheet feeding device 2. Since the configurations of the sheet conveying devices 100*a* and 100*b* are identical to each other, the following description is given of the sheet conveying device 100*a* as an example.

Figure 2:
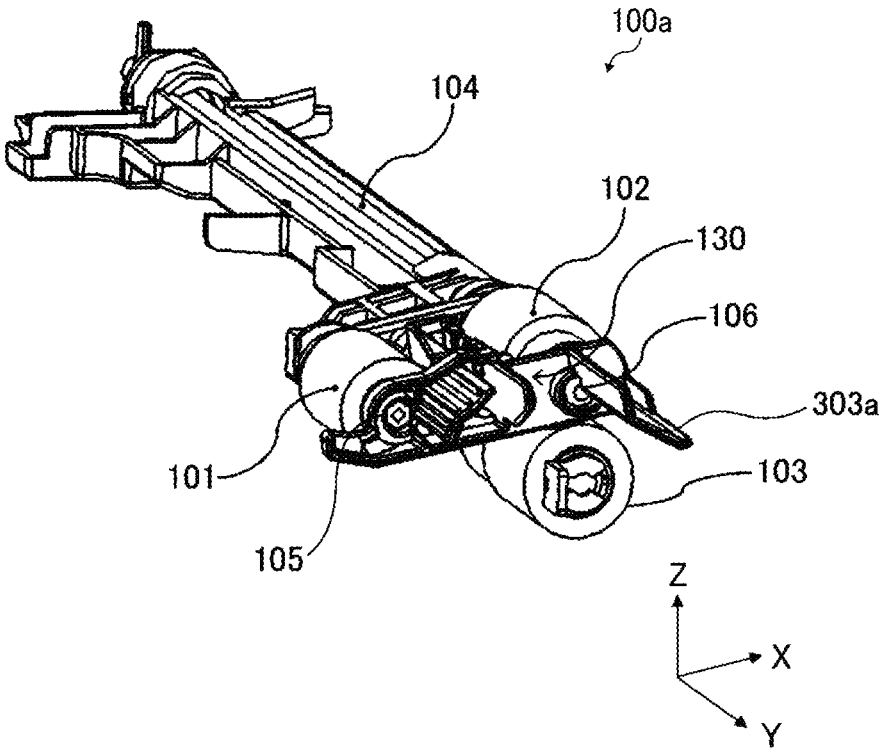
FIG. 2 is a perspective view illustrating the sheet conveying device of FIG. 1.
Figure 3:
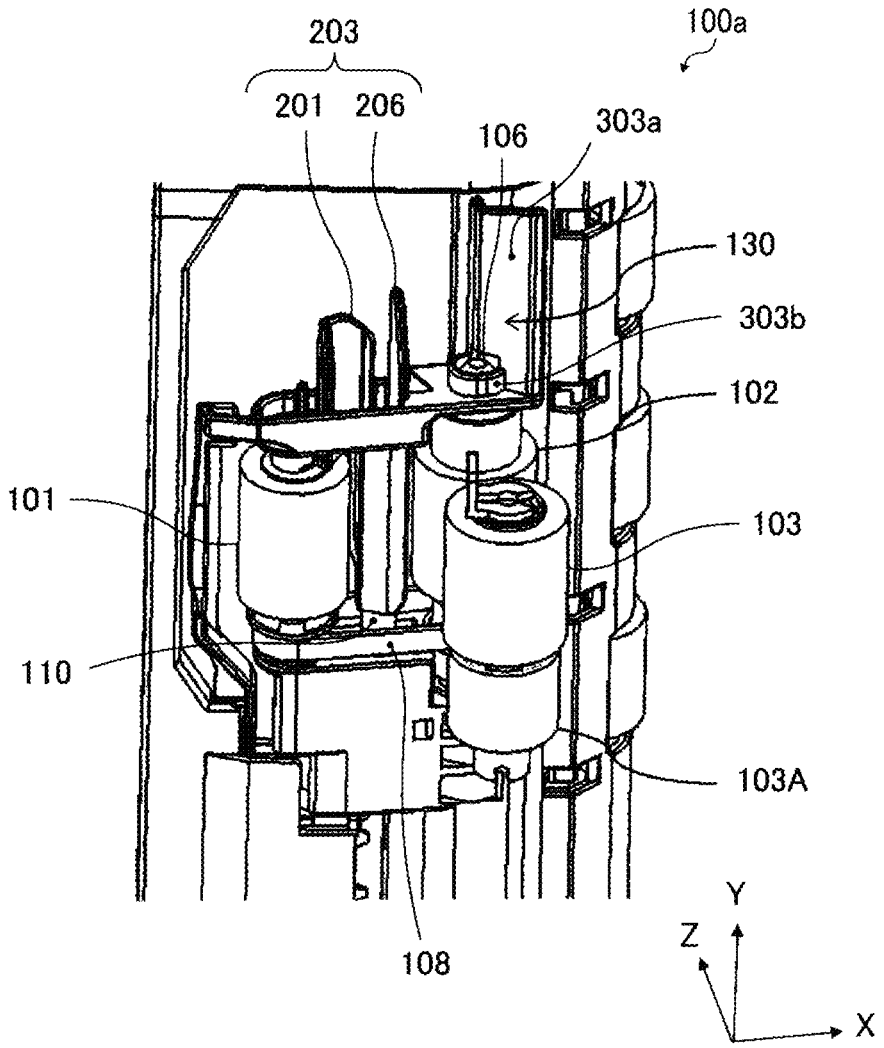
FIG. 3 is a diagram illustrating the sheet conveying device of FIG. 2, viewed from the bottom of the sheet conveying device.
Figure 4:
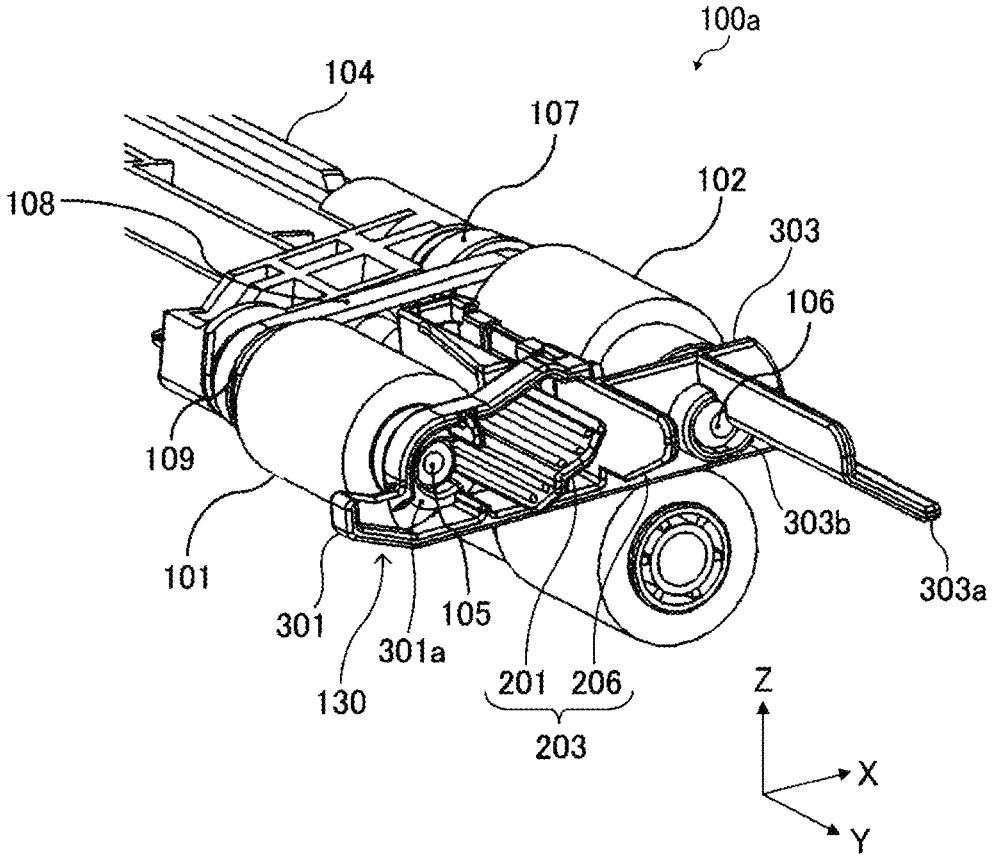
FIG. 4 is an enlarged perspective view illustrating the main part of the sheet conveying device of FIG. 2.

FIG. 2 is a perspective view illustrating the sheet conveying device 100*a* of FIG. 1. FIG. 3 is a diagram illustrating the sheet conveying device 100*a* of FIG. 2, viewed from the bottom of the sheet conveying device 100*a*. FIG. 4 is an enlarged perspective view illustrating the main part of the sheet conveying device 100*a* of FIG. 2.

Note that, hereinafter in the description below, the sheet conveyance direction is referred to as an X direction, an axial direction (thrust direction) is referred to as a Y direction, and a direction orthogonal to the X direction and the Y direction is referred to as a Z direction.

The sheet conveying device 100*a* includes, e.g., a pickup roller 101 that functions as a sheet conveying roller, a sheet feed roller 102 that functions as a sheet conveying roller, a sheet separation roller 103 that functions as a sheet separator, and a guide member 130 that functions as a sheet conveyance guide. The pickup roller 101 feeds and conveys the sheet 1. The sheet feed roller 102 conveys the sheet 1 downstream from the pickup roller 101 in the sheet conveyance direction. The sheet separation roller 103 is disposed facing the sheet feed roller 102 and separates the uppermost sheet 1 placed on top of the bundle of sheets loaded on the sheet tray 11 from the other sheets 1 of the bundle of sheets. The guide member 130 guides the sheet 1 when the sheet 1 is conveyed. The guide member 130 is detachably attached to a pickup roller shaft 105 and a sheet feed roller shaft 106, so that the guide member 130 guides the sheet 1 when being attached to the pickup roller shaft 105 and the sheet feed roller shaft 106.

The pickup roller 101 is disposed to contact the upper face of the sheet 1 loaded on the sheet tray 11. In a case in which a plurality of sheets 1 are fed out by the pickup roller 101, the uppermost sheet 1 of the plurality of sheets 1 is separated from the other sheets 1 of the bundle of sheets 1, between the sheet feed roller 102 and the sheet separation roller 103, and is conveyed from the sheet feeding device 2. The sheet 1 (uppermost sheet) fed from the sheet feeding device 2 is conveyed toward a pair of registration rollers 19 that is disposed between the sheet feeding device 2 and the transfer device 4. After the skew of the sheet 1 is corrected, the sheet 1 is conveyed to the transfer device 4.

The pickup roller 101 is disposed closest to the sheet trays 11 and 12 than other parts of the sheet conveying device 100*a* and is rotatably supported by the pickup roller shaft 105 that is provided on a pickup arm 104. The sheet feed roller 102 is supported on the tip end of the sheet feed roller shaft 106 that is rotated by a drive motor that functions as a driving source. The sheet feed roller 102 is prevented by the sheet feed roller shaft 106 from rotating backward and is rotated together with the sheet feed roller shaft 106.

The pickup arm 104 is rotatably provided to the housing of the image forming apparatus 10. As an electromagnetic solenoid causes the pickup arm 104 to rotate at the predetermined timing, the pickup arm 104 causes the pickup roller 101 to contact or separate from the sheet 1 that is loaded on the sheet tray 11 to feed the sheet 1.

As illustrated in FIG. 4, a one-way clutch 107 is mounted on the sheet feed roller shaft 106. The one-way clutch 107 has the teeth to mesh with the sheet feed roller shaft 106. The teeth of the one-way clutch 107 mesh with the sheet feed roller shaft 106 to transmit the driving force in the sheet conveyance direction. By contrast, the one-way clutch 107 idles when rotating in the opposite direction opposite the sheet conveyance direction. A pulley 109 with the teeth is mounted on the pickup roller 101. A timing belt 108 with the teeth is wound between the one-way clutch 107 and the pulley 109. According to this configuration, as the driving force is transmitted to the sheet feed roller shaft 106 to rotate the sheet feed roller shaft 106, the rotation of the sheet feed roller shaft 106 is transmitted to the timing belt 108 and the pulley 109 via the one-way clutch 107, so as to rotate the pickup roller 101 in the rotational direction of the pulley 109.

The sheet separation roller 103 contacts the sheet feed roller 102 with pressure to form a sheet separation nip region, so that the sheets 1 fed from the bundle of sheets 1 by the sheet feed roller 102 are separated to a single sheet 1 to be conveyed one by one. As illustrated in FIG. 3, a torque limiter 103A is mounted on the sheet separation roller 103. In a case in which the sheet 1 has not entered the sheet separation nip region or a single sheet 1 has entered the sheet separation nip region, the driving force of the sheet feed roller 102, which is a relatively large sheet conveyance force, is applied to the sheet separation roller 103. According to this configuration, the torque of rotation of the sheet separation roller 103 applied by the rotation of the sheet feed roller 102 is above the predetermined threshold, thereby the torque limiter 103A allows the sheet separation roller 103 to rotate along with the sheet feed roller 102. In other words, in a case in which the sheet 1 has not entered the sheet separation nip region or a single sheet 1 has entered in the sheet separation nip region, the sheet separation roller 103 is rotated along with the sheet feed roller 102.

By contrast, in a case in which a plurality of sheets 1 have entered in layers, the sheet feed roller 102 applies a relatively large sheet conveyance force to the uppermost sheet 1 that directly contacts the sheet feed roller 102 in the sheet separation nip region. Thus, the uppermost sheet 1 is fed in the sheet conveyance direction. On the other hand, the sheets 1 other than the uppermost sheet 1 are pressed in the sheet separation nip region to receive a conveyance resistance. When the conveyance resistance exceeds the frictional resistance between the uppermost sheet 1 and a second uppermost sheet 1, slippage occurs between the sheets 1, in other words, the uppermost sheet 1 slips on the second uppermost sheet 1. This slippage causes the torque of rotation of the sheet separation roller 103 that is rotated together with the sheet feed roller 102, to be equal to or less than the predetermined threshold value. Therefore, the torque limiter 103A no longer allows the sheet separation roller 103 to rotate together with the sheet feed roller 102. As a result, the conveyance resistance to the second uppermost sheet 1 and the subsequent sheets 1, which are the sheets after the second uppermost sheet 1, further increases to stop movement of the second uppermost sheet 1 and the subsequent sheets 1. Thus, the sheet separation roller 103 separates the uppermost sheet 1 from the other sheets 1 while applying the conveyance resistance to the plurality of sheets 1.

Next, a description is given of the guide member 130 according to the present embodiment.

Figure 5:
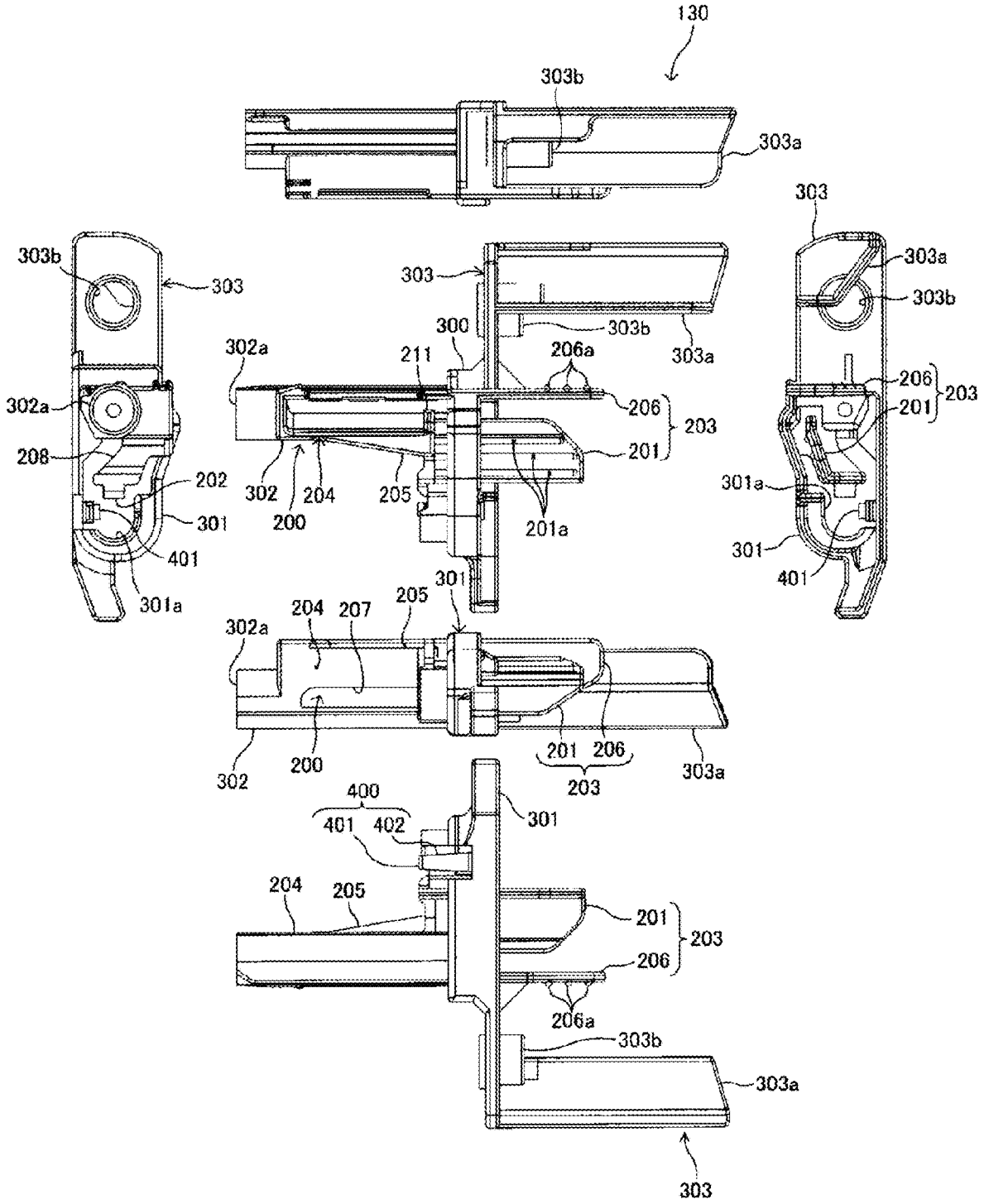
FIG. 5 is a developed view illustrating a guide included in the sheet conveying device of FIG. 2.
Figure 6:
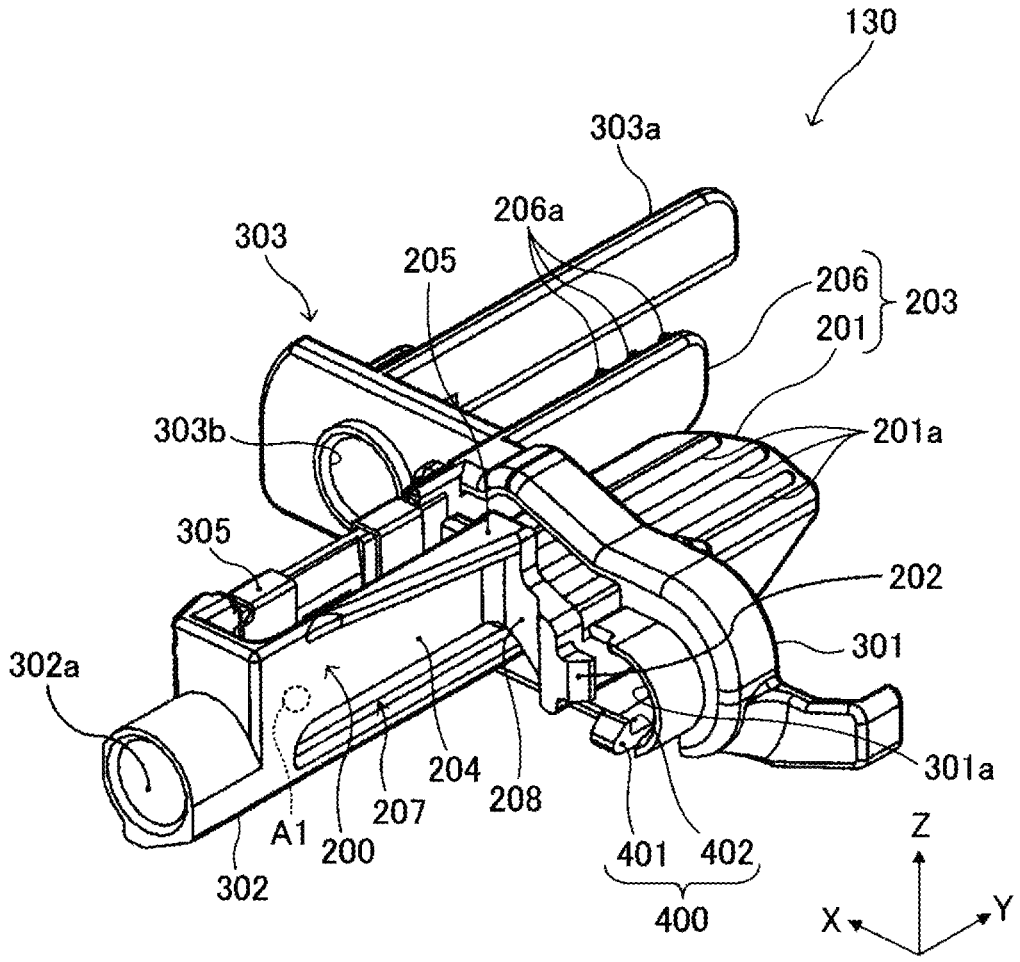
FIG. 6 is a perspective view illustrating the guide of FIG. 5, viewed in the −Y direction.
Figure 7:
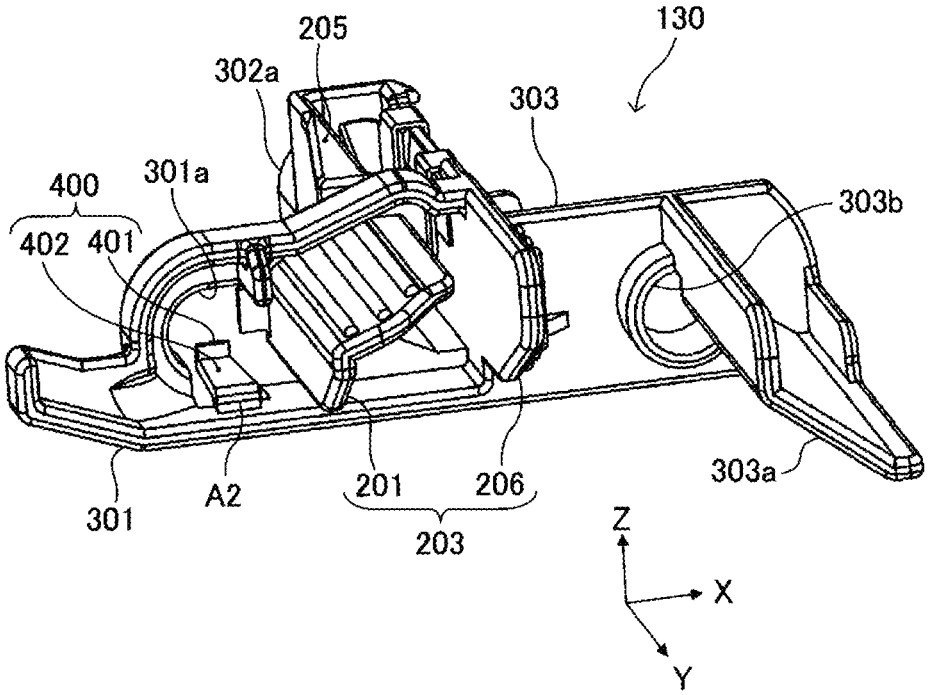
FIG. 7 is a perspective view illustrating the guide of FIG. 5, viewed in the +Y direction.
Figure 8:
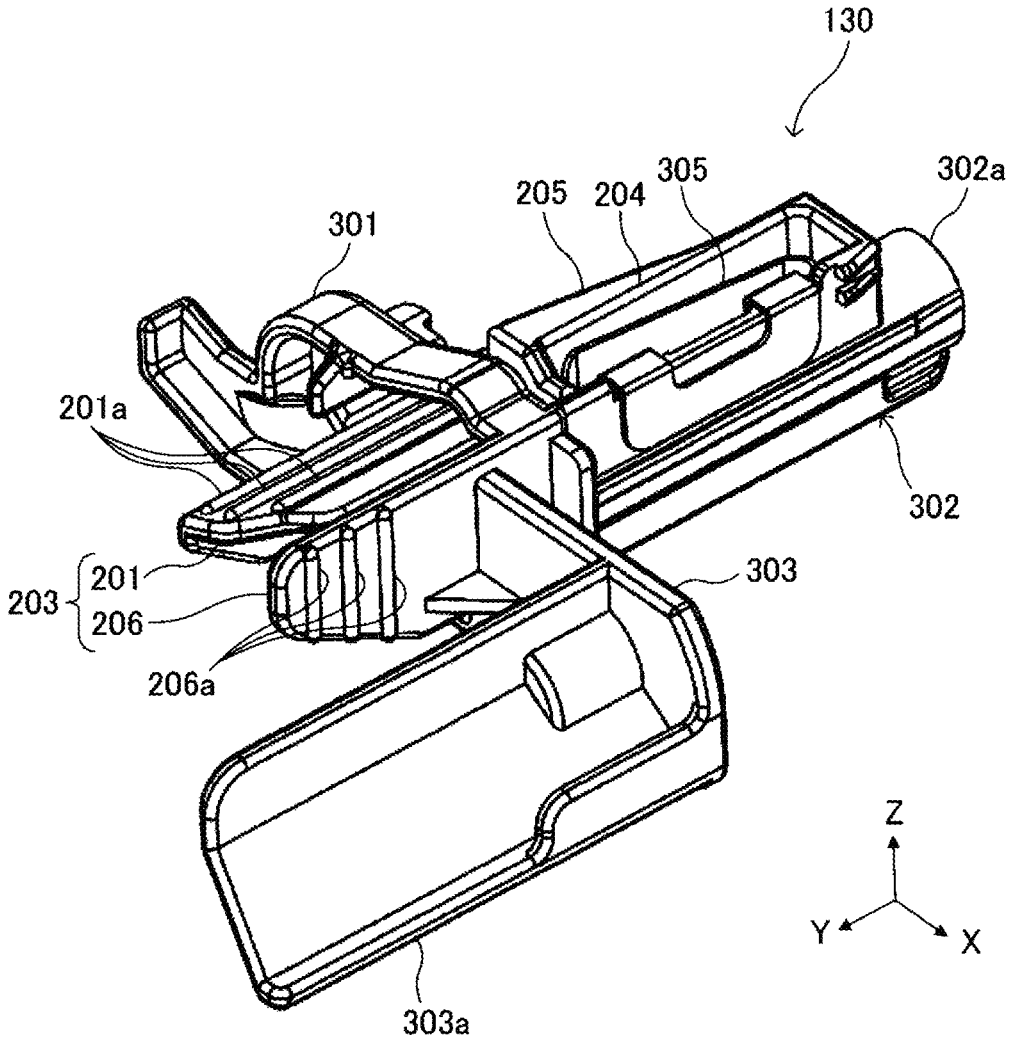
FIG. 8 is a perspective view illustrating the guide of FIG. 5, viewed in the +X direction.
Figure 9:
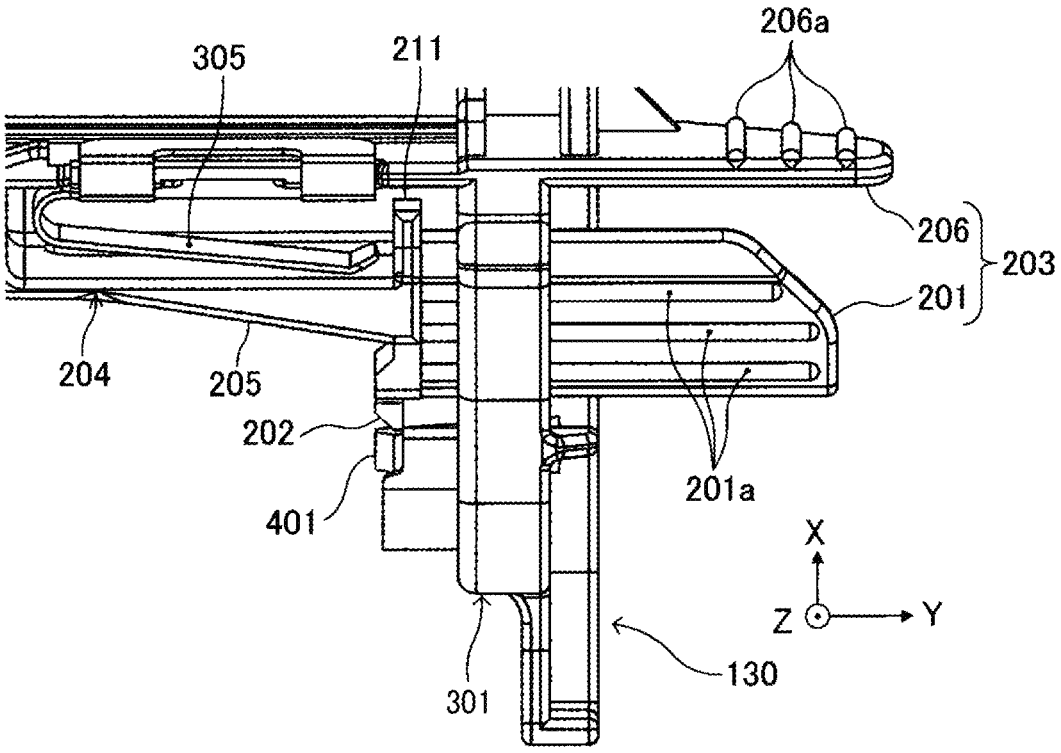
FIG. 9 is an enlarged front view illustrating a main part of the guide of FIG. 5.

FIG. 5 is a developed view illustrating the guide member 130 included in the sheet conveying device 100*a* of FIG. 2. FIG. 6 is a perspective view illustrating the guide member 130 of FIG. 5, viewed in the −Y direction. FIG. 7 is a perspective view illustrating the guide member 130 of FIG. 5, viewed in the +Y direction. FIG. 8 is a perspective view illustrating the guide member 130 of FIG. 5, viewed in the +X direction. FIG. 9 is an enlarged front view illustrating a main part of the guide member 130 of FIG. 5.

The guide member 130 includes a first support portion 301, a second support portion 302, and a third support portion 303.

The first support portion 301 has a first shaft insertion hole 301*a* into which the pickup roller shaft 105 is inserted. The second support portion 302 extends in the −Y direction from the downstream end of the first support portion 301 in the sheet conveyance direction (that is, the end of the first support portion 301 in the +X direction). The second support portion 302 has a pin insertion hole 302*a* at the tip end, so that a guide support pin 110 of the sheet conveying device 100*a* (see FIG. 10B) is inserted into the pin insertion hole 302*a* of the second support portion 302. That is, the second support portion 302 is supported by the guide support pin 110 of the sheet conveying device 100*a*. The inner diameter of the pin insertion hole 302*a* is substantially the same as the outer diameter of the guide support pin 110.

The third support portion 303 extends in the +X direction from the downstream end of the first support portion 301 in the sheet conveyance direction (that is, the end of the first support portion 301 in the +X direction). The third support portion 303 has a second shaft insertion hole 303*b* into which the sheet feed roller shaft 106 is inserted. As illustrated in FIG. 8, the third support portion 303 extends in the +X direction from a portion that is displaced in the +Y direction with respect to the portion of the first support portion 301 extending in the X direction. The inner diameter of the second shaft insertion hole 303*b* is substantially the same as the outer diameter of the sheet feed roller shaft 106.

The third support portion 303 has a guide portion 303*a*, which extends in the +Y direction, faces the sheet 1 from above while the sheet 1 is being conveyed, and guides the sheet 1. The guide portion 303*a* has a sloped face that descends downstream in the sheet conveyance direction (the +X direction). The end portion of the sloped face of the guide portion 303*a* in the −X direction is located at the substantially same position as the position of the sheet feed roller 102 in the X direction.

The guide portion 303*a* restrains the sheet 1 from exceedingly lifting upward from the sheet conveyance passage while the sheet 1 is conveyed from the pickup roller 101 in the sheet conveyance direction, and therefore restrains the sheet 1 from contacting the parts around the sheet conveyance passage. Accordingly, occurrence of the paper jam of the sheet 1 is restrained.

The guide member 130 includes a first thrust direction retainer 200 and a second thrust direction retainer 400, each engaging with the pickup roller shaft 105 and latching the guide member 130 together with the pickup roller shaft 105.

The first thrust direction retainer 200 that functions as a first thrust direction retainer includes a first engagement claw 202, a first elastic deformation portion 204, and a coupling portion 208. The first engagement claw 202 functions as a first engagement portion to engage with the pickup roller shaft 105. The first elastic deformation portion 204 elastically deforms so that the first engagement claw 202 moves between an engaging position at which the first engagement claw 202 engages with the pickup roller shaft 105 and a releasing position at which the engagement of the first engagement claw 202 with the pickup roller shaft 105 is released. The coupling portion 208 couples the first elastic deformation portion 204 with the first engagement claw 202. The first thrust direction retainer 200 further includes a guide release operation unit 203 to elastically deform the first elastic deformation portion 204 to move the first engagement claw 202 from the engaging position to the releasing position manually by a user. The first thrust direction retainer 200 further includes a stopper 211 that extends in the +X direction from the end of the first elastic deformation portion 204 in the +Y direction.

The first elastic deformation portion 204 is the side wall of the rectangular-shaped portion of the second support portion 302 that extends in the −X direction with the upper part and the end portion of the second support portion 302 in the +Y direction being open. The first elastic deformation portion 204 has a notch 207 that is a cut in the lower part of the second support portion 302. The first elastic deformation portion 204 elastically deforms in the X direction.

A rib 205 is provided on the upper part of the first elastic deformation portion 204. The rib 205 extends in the −Y direction from the coupling portion 208. As the rib 205 tilts in the −Y direction, the amount of projection in the −X direction with respect to the first elastic deformation portion 204 decreases. As illustrated in FIG. 8, when viewed from the top, the rib 205 substantially has the shape of a right triangle. The end portion (tip end) of the rib 205 in the −Y direction is located in the −Y direction from the center of the first elastic deformation portion 204 in the Y direction. This configuration with the rib 205 increases the rigidity of the first elastic deformation portion 204 close to the coupling portion 208 (in the +Y direction). Accordingly, the first elastic deformation portion 204 is elastically deformed at a fulcrum A1 at the end portion in the −Y direction as a fulcrum point, as indicated by a broken line in FIG. 6.

A leaf spring 305 is attached to the second support portion 302. The leaf spring 305 is located on the rectangular-shaped portion of the second support portion 302 extending in the −X direction, with the upper part being open, and biases the first elastic deformation portion 204 in the −X direction.

Further, the guide release operation unit 203 included in the first thrust direction retainer 200 includes a movable operation portion 201 and a fixed operation portion 206. The movable operation portion 201 projects from the end portion in the +Y direction of each of the first elastic deformation portion 204 and the coupling portion 208 and goes through the first support portion 301. A plurality of ribs 201*a* is disposed on an operation face of the movable operation portion 201, extending in the Y direction. The operation face is a contact face on which the finger of a user touches when operating the movable operation portion 201. The fixed operation portion 206 has a plate shape that projects and extends in the +Y direction from the end portion of the downstream side in the sheet conveyance direction (the +X direction side) of the first support portion 301. A plurality of ribs 206*a* extends in the Z direction and is disposed on an operation face of the fixed operation portion 206, which is opposite the face opposing to the movable operation portion 201. The operation face of the fixed operation portion 206 is a contact face on which the finger of the user touches when operating the movable operation portion 201.

When the first engagement claw 202 is disengaged from the pickup roller shaft 105, a user touches and picks up the operation face of the fixed operation portion 206 and the operation face of the movable operation portion 201, so as to move the movable operation portion 201 toward the fixed operation portion 206. Then, the first elastic deformation portion 204 is elastically deformed in the +X direction at the fulcrum A1 as a fulcrum point, so that the first engagement claw 202 moves from the engaging position to the releasing position. Then, as the stopper 211 contacts the side wall of the second support portion 302, at which the second support portion 302 faces the first engagement claw 202 and movement of the movable operation portion 201 is restricted by the fixed operation portion 206, the first engagement claw 202 and the pickup roller shaft 105 are disengaged from each other. Then, by moving the guide release operation unit 203 in the +Y direction while the guide release operation unit 203 is being picked up, the guide member 130 moves in the +Y direction to detach the guide member 130 from the sheet conveying device 100*a*.

The second thrust direction retainer 400 that functions as a second thrust direction retainer includes a second engagement claw 401 and a second elastic deformation portion 402. The second engagement claw 401 functions as a second engagement portion to engage with the pickup roller shaft 105. The second elastic deformation portion 402 extends in the − direction from the first support portion 301 and goes through the first shaft insertion hole 301*a*. The second engagement claw 401 is provided on the tip end of the second elastic deformation portion 402 to project upward (in the +Z direction). The second elastic deformation portion 402 elastically deforms so that the second engagement claw 401 moves between an engaging position at which the second engagement claw 401 engages with the pickup roller shaft 105 and a releasing position at which the engagement of the second engagement claw 401 with the pickup roller shaft 105 is released.

Figure 10A:
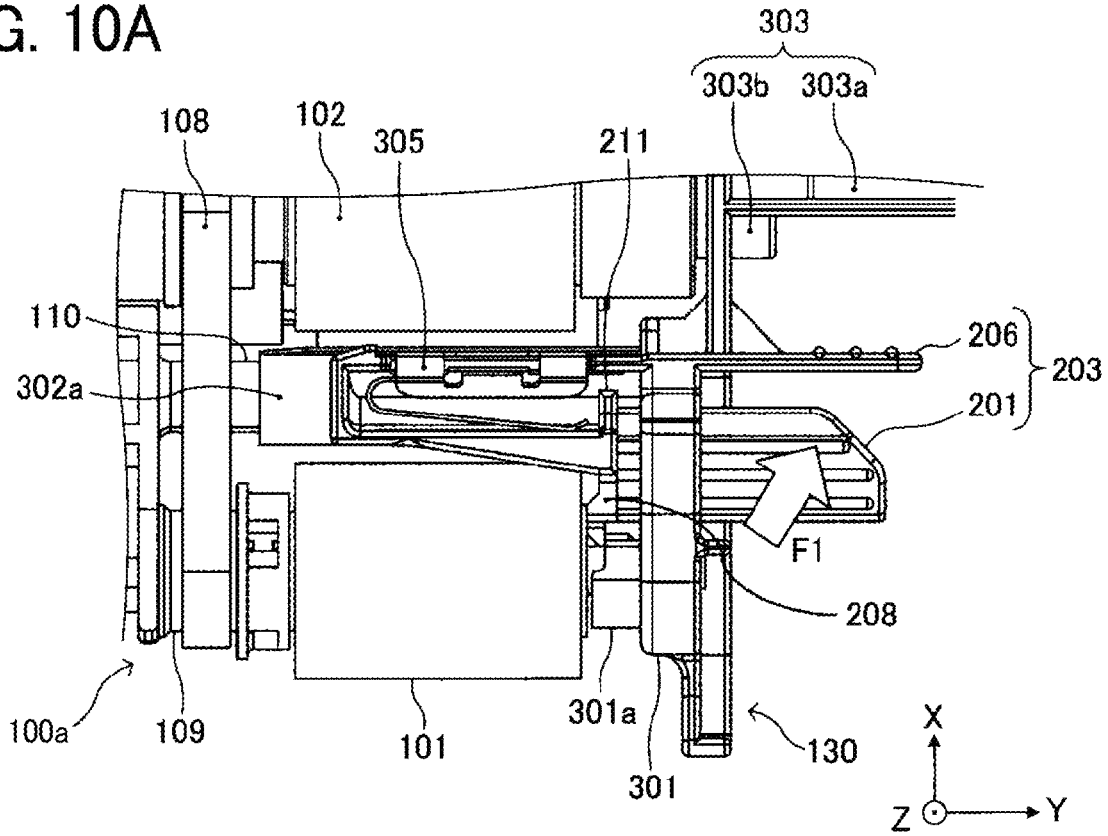
FIG. 10A is a diagram illustrating the sheet conveying device of FIG. 2, with the guide of FIG. 5 attached.
Figure 10B:
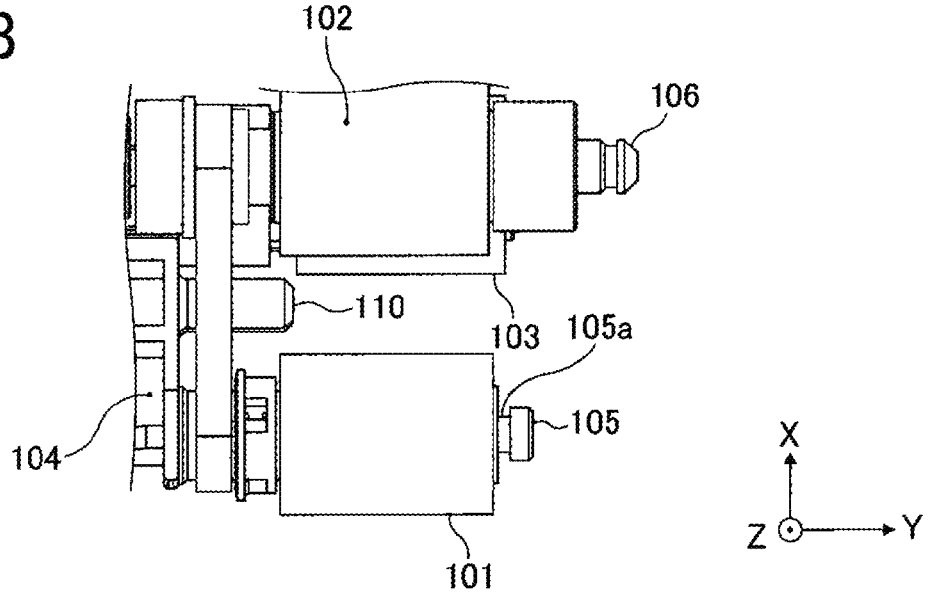
FIG. 10B is a diagram illustrating the sheet conveying device of FIG. 2, without the guide of FIG. 5.

FIG. 10A is a diagram illustrating the sheet conveying device 100*a* of FIG. 2, with the guide member 130 of FIG. 5 being attached. FIG. 10B is a diagram illustrating the sheet conveying device 100*a* of FIG. 2, without the guide member 130 of FIG. 5.

As illustrated in FIG. 10B, the pickup roller shaft 105 has an engagement groove 105*a* as an engagement target portion to engage with each of the first engagement claw 202 and the second engagement claw 401. The guide support pin 110 is attached to the pickup arm 104 in a cantilever manner. The guide support pin 110 is disposed between the pickup roller 101 and the sheet feed roller 102 in the X direction to pass through the inner circumference of the timing belt 108.

The guide member 130 is moved from the +Y direction side to the −Y direction side, so that the guide member 130 is attached to the sheet conveying device 100*a*. To be more specific, as the guide member 130 in the −Y direction, the guide support pin 110 is inserted into the pin insertion hole 302*a*, and therefore the tip end of the sheet feed roller shaft 106 is inserted into the second shaft insertion hole 303*b*. Further, the tip end of the pickup roller shaft 105 is inserted into the first shaft insertion hole 301*a*. Further, the first engagement claw 202 of the first thrust direction retainer 200 and the second engagement claw 401 of the second thrust direction retainer 400 are inserted into the engagement groove 105*a*, so that the first engagement claw 202 and the second engagement claw 401 are engaged with the engagement groove 105*a* in the thrust direction.

The diameter of the guide support pin 110 is substantially same as the inner diameter of the pin insertion hole 302*a*. Therefore, by inserting the guide support pin 110 into the pin insertion hole 302*a*, the guide member 130 is positioned to the sheet conveying device 100*a* in the Y direction and the Z direction. Further, the tip end of the sheet feed roller shaft 106 is substantially same as the inner diameter of the second shaft insertion hole 303*b*. Therefore, by inserting the tip end of the sheet feed roller shaft 106 into the second shaft insertion hole 303*b*, the guide member 130 is positioned to the sheet conveying device 100*a* about the Y direction.

By engaging the first engagement claw 202 and the second engagement claw 401 with the engagement groove 105*a*, the guide member 130 is attached to the sheet conveying device 100*a*. The engagement groove 105*a* that engages with each of the first engagement claw 202 and the second engagement claw 401 is mounted on the pickup roller shaft 105 that is a fixed shaft that does not rotate. According to this configuration, the sliding of each of the first engagement claw 202 and the second engagement claw 401 with the engagement groove 105*a* is prevented, and therefore the first engagement claw 202 and the second engagement claw 401 are prevented from being cut.

Further, while the sheet feed roller shaft 106 is inserted in the second shaft insertion hole 303*b* and the guide member 130 is attached to the sheet conveying device 100*a*, the third support portion 303 faces the sheet feed roller 102. According to this configuration, the third support portion 303 stops the sheet feed roller 102 from coming off from the sheet feed roller shaft 106. Accordingly, in the present embodiment, the guide member 130 functions as a retainer to stop the sheet feed roller 102 from coming off from the sheet feed roller shaft 106, and therefore another retainer other than the guide member 130 to stop the sheet feed roller 102 from coming off is not provided. According to this configuration, the number of parts is decreased, thereby enhancing a reduction in cost of the sheet conveying device 100*a*. Further, when replacing the sheet feed roller 102 to a new sheet feed roller, the guide member 130 alone is removed, and therefore the sheet conveying device 100*a* has a good operability in replacing the sheet feed roller 102.

While the pickup roller shaft 105 is inserted in the first shaft insertion hole 301*a* and the guide member 130 is attached to the sheet conveying device 100*a*, the first support portion 301 faces the pickup roller 101. According to this configuration, the first support portion 301 stops the pickup roller 101 from coming off from the pickup roller shaft 105. Accordingly, in the present embodiment, the guide member 130 functions as a retainer to stop the pickup roller 101 from coming off from the pickup roller shaft 105, and therefore another retainer other than the guide member 130 to stop the pickup roller 101 from coming off is not provided. According to this configuration, the number of parts is decreased, thereby enhancing a reduction in cost of the sheet conveying device 100*a*. Further, when replacing the pickup roller 101 to a new pickup roller, the guide member 130 alone is removed, and therefore the sheet conveying device 100*a* has a good operability in replacing the pickup roller 101.

When handling the paper jam, it is likely that a user unintentionally touches the movable operation portion 201 by the finger. In the paper jam handling, in a case in which the user unintentionally touches the movable operation portion 201 by the finger in a direction indicated by arrow F1 as illustrated in FIG. 10A, the movable operation portion 201 is moves toward the fixed operation portion 206 to move the first engagement claw 202 from the engaging position at which the first engagement claw 202 is engaged with the engagement groove 105*a*, to the releasing position at which the first engagement claw 202 is disengaged (released) from the engagement groove 105*a*. Further, at this time, a force is also applied to the guide member 130 in the +Y direction in which the guide member 130 is detached from the sheet conveying device 100*a*.

A comparative sheet conveying device does not include the second thrust direction retainer 400, and therefore has the configuration in which the engagement groove 105*a* of the pickup roller shaft 105 engages with the first engagement claw 202 of the first thrust direction retainer 200. Therefore, in the comparative sheet conveying direction, when the finger of a user touches the movable operation portion 201 unintentionally, if there are a force applied to the movable operation portion 201 in the +X direction and a force applied to the movable operation portion 201 in the +Y direction, as the first engagement claw 202 moves to the releasing position, the guide member 130 is moved to the +Y direction. As a result, the guide support pin 110, the tip end of the sheet feed roller shaft 106, and the tip end of the pickup roller shaft 105 come off from the insertion holes of the guide member 130, resulting that the guide member 130 comes off from the sheet conveying device 100*a*.

On the other hand, the sheet conveying device 100*a* according to the present embodiment includes the second thrust direction retainer 400, and therefore the engagement groove 105*a* of the pickup roller shaft 105 engages with the first engagement claw 202 of the first thrust direction retainer 200 and the second engagement claw 401 of the second thrust direction retainer 400. According to this configuration, when the finger of a user touches the movable operation portion 201 unintentionally and the force is applied to the movable operation portion 201 in the direction indicated by arrow F1 in FIG. 10A, if the first engagement claw 202 is moved to the releasing position and then the guide member 130 is about to move in the Y direction, the second engagement claw 401 contacts the end portion of the engagement groove 105*a* in the +Y direction. As a result, the second engagement claw 401 regulates movement of the guide member 130 in the +Y direction. Therefore, even if the finger of the user unintentionally contacts the movable operation portion 201 in the paper jam handling, the guide member 130 does not come off from the guide support pin 110, the tip end of the sheet feed roller shaft 106, and the pickup roller shaft 105, and therefore does not come off from the sheet conveying device 100*a*.

Further, in the present embodiment, the engaging force of the first engagement claw 202 with the engagement groove 105*a* is greater than the engaging force of the second engagement claw 401 with the engagement groove 105*a*. Note that the engaging force is a force in the thrust direction to release the engagement of each engagement claw with the engagement groove 105*a*. Next, a detailed description is given of the configuration of the sheet conveying device 100*a*, with reference to FIGS. 11A and 11B.

Figure 11A:
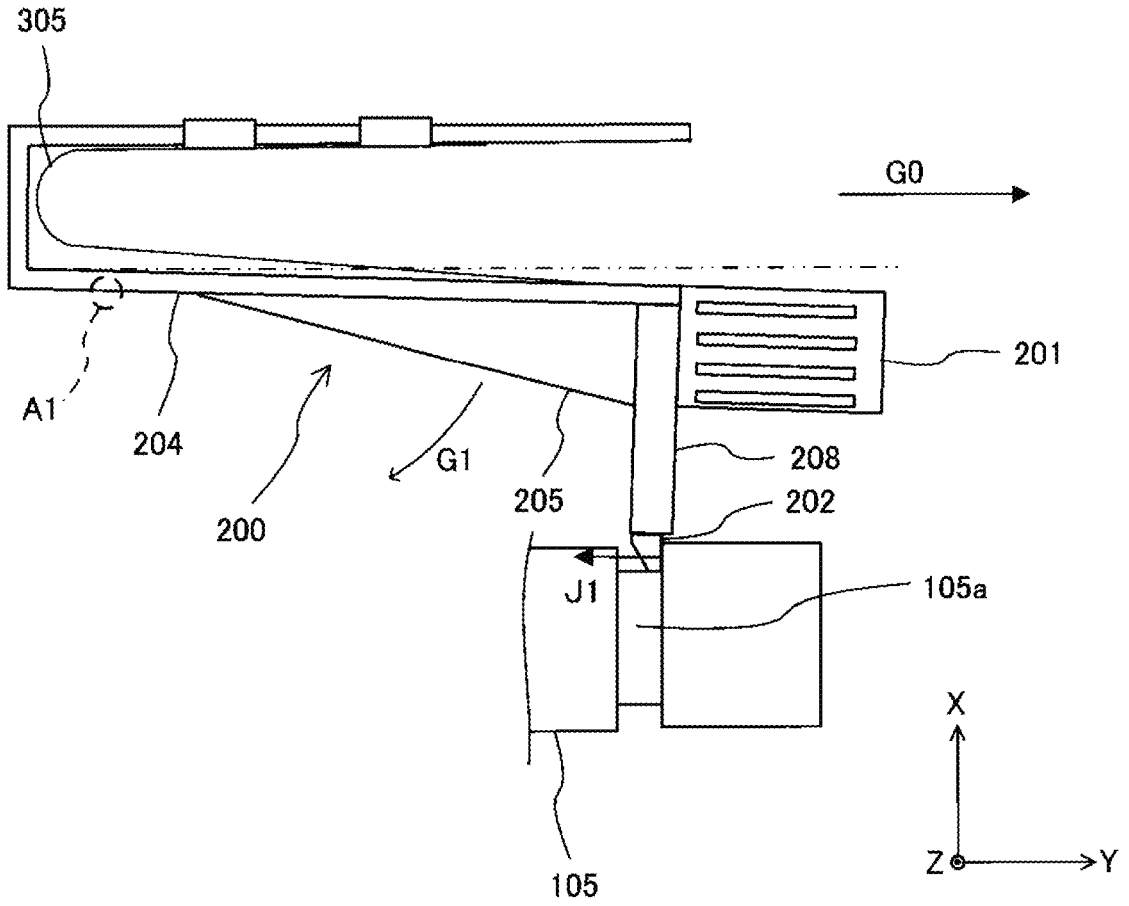
FIG. 11A is a diagram illustrating elastic deformation of the first elastic deformation portion when the first engagement claw has received the force from the end portion of the engagement groove in the +Y direction.
Figure 11B:
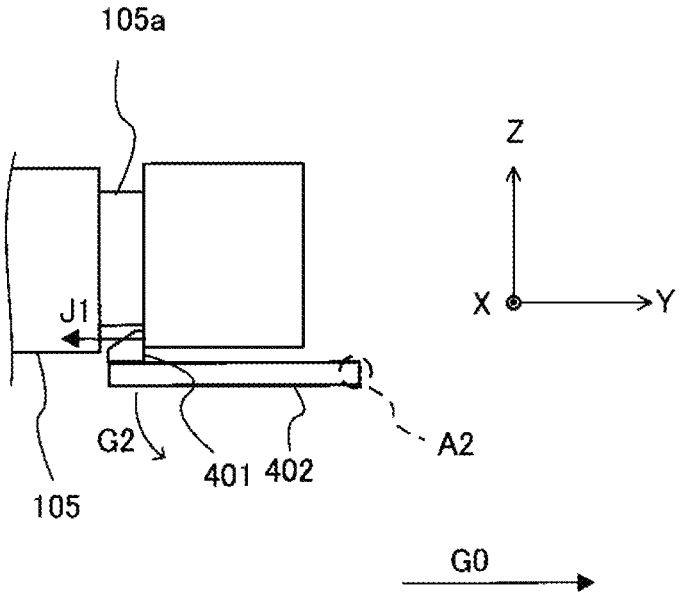
FIG. 11B is a diagram illustrating elastic deformation of the second elastic deformation portion when the second engagement claw has received the force from the end portion of the engagement groove in the +Y direction.

FIGS. 11A and 11B are diagrams illustrating elastic deformation of the first elastic deformation portion 204 and the second elastic deformation portion 402 when the first engagement claw 202 and the second engagement claw 401 have received the force from the end portion of the engagement groove 105*a* in the +Y direction. To be more specific, FIG. 11A is a diagram illustrating elastic deformation of the first elastic deformation portion 204 when the first engagement claw 202 has received the force from the end portion of the engagement groove 105*a* in the +Y direction and FIG. 11B is a diagram illustrating elastic deformation of the second elastic deformation portion 402 when the second engagement claw 401 has received the force from the end portion of the engagement groove 105*a* in the +Y direction.

When the force is applied to the guide member 130 in the detachment direction of the guide member 130 (i.e., the direction indicated by arrow G0 in FIG. 11A, that is, the +Y direction) while the first engagement claw 202 and the second engagement claw 401 are engaged with the engagement groove 105*a*, the first engagement claw 202 contacts the end portion of the engagement groove 105*a* in the +Y direction, so that the first engagement claw 202 receives the reaction force from the engagement groove 105*a* in the −Y direction (i.e., the direction indicated by arrow J1 in FIG. 11A). The −Y direction (direction indicated by arrow J1 in FIG. 11A) is an attachment direction in which the first engagement claw 202 engages with the engagement groove 105*a*. As illustrated in FIG. 11A, the coupling portion 208 is coupled with the rib 205 and the movable operation portion 201, and there fore the coupling portion 208 is reinforced in the Y direction. Therefore, when the first engagement claw 202 receives the reaction force from the engagement groove 105*a* in the −Y direction (i.e., the direction indicated by arrow J1 in FIG. 11A), the coupling portion 208 hardly makes elastic deformation at the joint portion functioning as a fulcrum point, with the first elastic deformation portion 204 and maintains the substantially initial position.

Further, the rib 205 enhances the rigidity of the first elastic deformation portion 204 in the +Y direction. According to this configuration, when the first engagement claw 202 receives the reaction force from the engagement groove 105*a* in the −Y direction (i.e., the direction indicated by arrow J1 in FIG. 11A), the first elastic deformation portion 204 hardly makes elastic deformation in the +Y direction. Therefore, in the present embodiment, when the first engagement claw 202 receives the reaction force from the engagement groove 105*a* in the −Y direction (i.e., the direction indicated by arrow J1 in FIG. 11A), the first elastic deformation portion 204 elastically deforms in the direction indicated by arrow G1 in FIG. 11A, at the fulcrum A1 functioning as a fulcrum point near the end portion of the first elastic deformation portion 204 in the −Y direction. Accordingly, since the first thrust direction retainer 200 is configured to be elastically deformed at a fulcrum point upstream from the first engagement claw 202 in the detachment direction of the guide member 130, when the first engagement claw 202 receives the reaction force from the engagement groove 105*a* in the −Y direction (i.e., the direction indicated by arrow J1 in FIG. 11A), the first elastic deformation portion 204 is elastically deformed in the direction indicated by arrow G1 in FIG. 11A. By so doing, the first engagement claw 202 is to move in the direction to insert into the engagement groove 105*a*. As a result, the first thrust direction retainer 200 has a strong engaging force to prevent from being disengaged from the engagement groove 105*a* unless the guide release operation unit 203 is operated to move the first engagement claw 202 to the releasing position. Accordingly, in the first thrust direction retainer 200, the guide member 130 is fixedly attached to the pickup roller shaft 105 unless the guide release operation unit 203 is operated, and therefore the guide member 130 is preferably restrained from being coming off from the sheet conveying device 100*a* while the sheet is being conveyed.

Further, in the present embodiment, the leaf spring 305 biases the end portion in the +Y direction of the first elastic deformation portion 204, toward the −X direction. By so doing, the first engagement claw 202 is biased by the leaf spring 305 in the direction in which the first engagement claw 202 is inserted into the engagement groove 105*a*, so that the engagement of the first engagement claw 202 and the engagement groove 105*a* is tighter (in other words, the engaging force is stronger). Accordingly, the first thrust direction retainer 200 attaches the guide member 130 to the sheet conveying device 100*a* more reliably.

Further, since the leaf spring 305 biases the end portion in the +Y direction of the first elastic deformation portion 204, toward the −X direction, when the first engagement claw 202 is engaged with the engagement groove 105*a*, the first elastic deformation portion 204 is sloped in the Y direction so that the +Y direction side of the first elastic deformation portion 204 is located in the −X direction. As described above, since the first elastic deformation portion 204 is sloped in the Y direction, when the first engagement claw 202 receives the reaction force from the engagement groove 105*a* in the −Y direction (i.e., the direction indicated by arrow J1 in FIG. 11A), the first elastic deformation portion 204 is elastically deformed easily in the direction indicated by arrow G1 in FIG. 11A, at the fulcrum A1 functioning as a fulcrum point. Note that the fulcrum point A1 of elastic deformation of the first elastic deformation portion 204 is located upstream from the first engagement claw 202 in the detachment direction (the +Y direction). Accordingly, the first thrust direction retainer 200 attaches the guide member 130 to the sheet conveying device 100*a* more reliably.

On the other hand, as illustrated in FIG. 11B, the end portion in the +Y direction of the second elastic deformation portion 402 of the second thrust direction retainer 400 is coupled with the first support portion 301 and is supported by the first support portion 301 in a cantilever manner. Therefore, the second elastic deformation portion 402 is elastically deformed at the end portion in the +Y direction as a fulcrum point (that is indicated by a broken line A2 in FIG. 11B). Note that the fulcrum point A2 of elastic deformation of the second elastic deformation portion 402 is located downstream from the second engagement claw 401 in the detachment direction (the +Y direction). Accordingly, the second thrust direction retainer 400 is configured to be elastically deformed at a fulcrum point downstream from the second engagement claw 401 in the detachment direction of the guide member 130, and the fulcrum point of elastic deformation of the second thrust direction retainer 400 is located opposite to the first thrust direction retainer 200 in the Y direction, based on the engaging portion with the shaft. According to this configuration, when the second engagement claw 401 receives the reaction force from the engagement groove 105*a* in the −Y direction (i.e., the direction indicated by arrow J1 in FIG. 11B), the second elastic deformation portion 402 is elastically deformed in the direction indicated by arrow G2 in FIG. 11B. The −Y direction (direction indicated by arrow J1 in FIG. 11A) is an attachment direction in which the second engagement claw 401 engages with the engagement groove 105*a*. This elastic deformation of the second elastic deformation portion 402 causes the second engagement claw 401 to move in the direction to cancel (release) the engagement with the engagement groove 105*a*. In response to this disengagement of the second engagement claw 401 from the engagement groove 105*a*, the engagement of the second thrust direction retainer 400 is cancelled (released) by a predetermined force in the thrust direction, so that the engaging force of the second thrust direction retainer 400 is weaker (smaller) than the engaging force of the first thrust direction retainer 200. According to this configuration, even though the second thrust direction retainer 400 does not include the guide release operation unit 203, the engagement of the second thrust direction retainer 400 with the engagement groove 105*a* is cancelled (released) reliably. Therefore, by pulling the guide release operation unit 203 in the +Y direction by the predetermined force while the first engagement claw 202 is moved to the releasing position by operating the guide release operation unit 203, the second elastic deformation portion 402 is elastically deformed in the direction indicated by arrow G2 in FIG. 11B, cancelling (releasing) the engagement of the second engagement claw 401 with the engagement groove 105*a*. Accordingly, the guide member 130 is detached from the sheet conveying device 100*a* to replace the pickup roller 101 or the sheet feed roller 102.

Further, in the present embodiment, when the guide member 130 is detached from the sheet conveying device 100*a* while the engagement of the first engagement claw 202 with the engagement groove 105*a* by operating the guide release operation unit 203, the second engagement claw 401 remains engaged with the engagement groove 105*a*. Therefore, the guide release operation unit 203 is pulled in the +Y direction to cancel (release) the engagement of the second engagement claw 401 with the engagement groove 105*a*. When pulling the guide release operation unit 203 in the +Y direction by the predetermined force, it is likely that the user slips the finger that is picking (holding) the guide release operation unit 203. In order to prevent such an inconvenience, as described above, the present embodiment provides the configuration in which the ribs 206*a* are formed on the operation face (contact face) of the fixed operation portion 206, to which the finger of a user contacts when operating the guide release operation unit 203, and the ribs 201*a* are formed on the operation face (contact face) of the movable operation portion 201, to which the finger of the user contacts when operating the guide release operation unit 203. By so doing, the operation face of the fixed operation portion 206 and the operation face of the movable operation portion 201 are uneven, in other words, have asperities. Accordingly, slippage of the finger of the user that is picking (holding) the guide release operation unit 203 is restrained when pulling the guide release operation unit 203 in the +Y direction by the predetermined force, and therefore the guide member 130 is detached from the sheet conveying device 100*a* reliably.

In the present embodiment, the ribs are provided on the operation face to make the operation face uneven (in the convex and concave shape). However, the operation face may have the convex and concave shape by roughening the operation face. Further, since the ribs 206*a* of the fixed operation portion 206 extend in the direction orthogonal to the Y direction that is the direction to pull the guide release operation unit 203, the finger of the user that has contacted the operation face of the fixed operation portion 206 is caught by the ribs 206*a* easily. Therefore, when compared with a configuration in which the ribs extend in parallel to the Y direction, this configuration restrains slippage of the finger. Note that, in the present embodiment, the ribs 201*a* of the movable operation portion 201 extends parallel to the Y direction. However, similar to the ribs 206*a* of the fixed operation portion 206, the ribs 201*a* of the movable operation portion 201 may extend in the direction orthogonal to the Y direction.

Figure 12A:
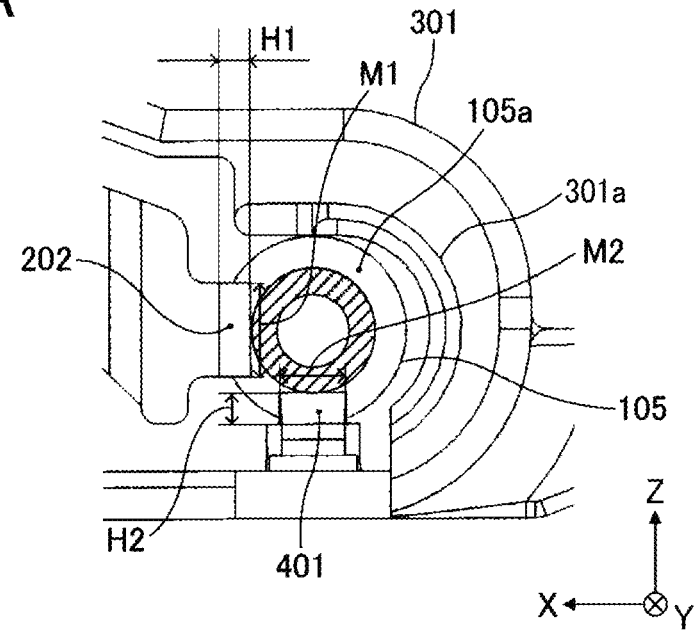
FIGS. 12A and 12B are cross sectional views each illustrating engagement of each of the first engagement claw and the second engagement claw, with the engagement groove.
Figure 12B:
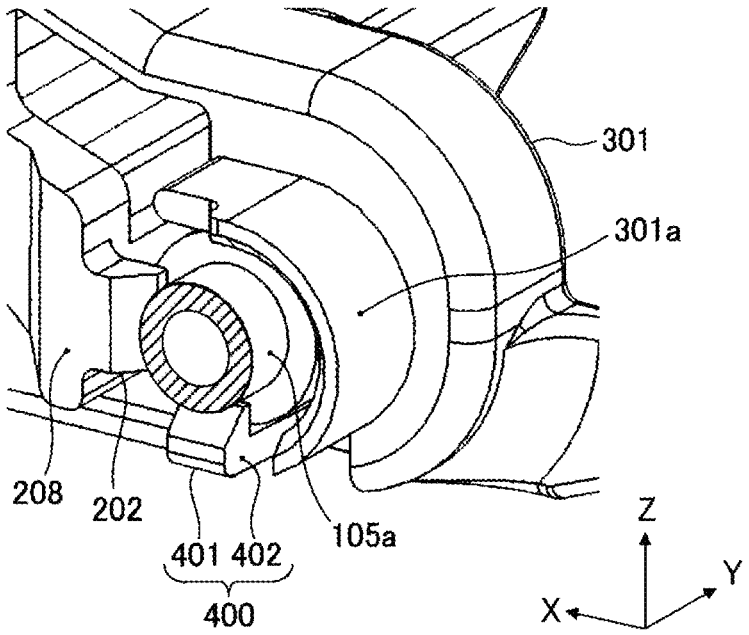

FIGS. 12A and 12B are cross sectional views each illustrating engagement of each of the first engagement claw 202 and the second engagement claw 401, with the engagement groove 105*a*.

As illustrated in FIG. 12A, the first engagement claw 202 and the second engagement claw 401 contact the bottom face of the engagement groove 105*a*. The amount of engagement H1 of the first engagement claw 202 with the engagement groove 105*a* is substantially same as the amount of engagement H2 of the second engagement claw 401 with the engagement groove 105*a*.

The first engagement claw 202 contacts the bottom face of the engagement groove 105*a* and the amount of engagement H1 of the first engagement claw 202 to the engagement groove 105*a* is set to the maximum amount of engagement. By so doing, the engaging force of the first engagement claw 202 to the engagement groove 105*a* is enhanced and easy disengagement of the first engagement claw 202 from the engagement groove 105*a* is further restrained. Accordingly, the guide member 130 is further preferably restrained from being coming off from the sheet conveying device 100*a* while the sheet is being conveyed.

Similarly, the second engagement claw 401 contacts the bottom face of the engagement groove 105*a* and the amount of engagement H2 of the second engagement claw 401 to the engagement groove 105*a* is set to the maximum amount of engagement. By so doing, even if the finger of the user unintentionally contacts the movable operation portion 201 and the engagement of the first engagement claw 202 and the engagement groove 105*a* is cancelled (released), the second engagement claw 401 restrains detachment of the guide member 130 from the sheet conveying device 100*a* reliably.

Further, the width M1 of the first engagement claw 202 is greater (wider) than the width M2 of the second engagement claw 401, and the rigidity of the first engagement claw 202 is greater (higher) than the rigidity of the second engagement claw 401. According to this configuration, as illustrated in FIG. 11A, when the first engagement claw 202 receives the force from the end portion of the engagement groove 105*a* in the +Y direction, the first engagement claw 202 is restrained from being elastically deformed in the −Y direction, and a reduction in the amount of engagement of the first engagement claw 202 with the engagement groove 105*a* is also restrained. Accordingly, the engaging force of the first engagement claw 202 with the engagement groove 105*a* is enhanced. Therefore, when the force is applied to the guide member 130 in the detaching direction of the guide member 130 (the +Y direction), the engagement of the first engagement claw 202 with the engagement groove 105*a* is further restrained from being cancelled (released).

On the other hand, the second engagement claw 401 has the rigidity that is weaker (smaller) than the rigidity of the first engagement claw 202. Therefore, as illustrated in FIG. 11B, when the second engagement claw 401 receives the force from the end portion of the engagement groove 105*a* in the +Y direction, the second engagement claw 401 is elastically deformed in the −Y direction easily. Therefore, the engaging force of the second engagement claw 401 with the engagement groove 105*a* becomes weaker (smaller) than the engaging force of the first engagement claw 202 with the engagement groove 105*a*. According to this configuration, when the guide member 130 is moved in the +Y direction while the first engagement claw 202 is located at the releasing position by operating the guide release operation unit 203, the engagement of the second engagement claw 401 with the engagement groove 105*a* is cancelled (released) more easily. Accordingly, when detaching the guide member 130 from the sheet conveying device 100*a* by operating the guide release operation unit 203, the guide member 130 is detached from the sheet conveying device 100*a* easily.

Figure 13:
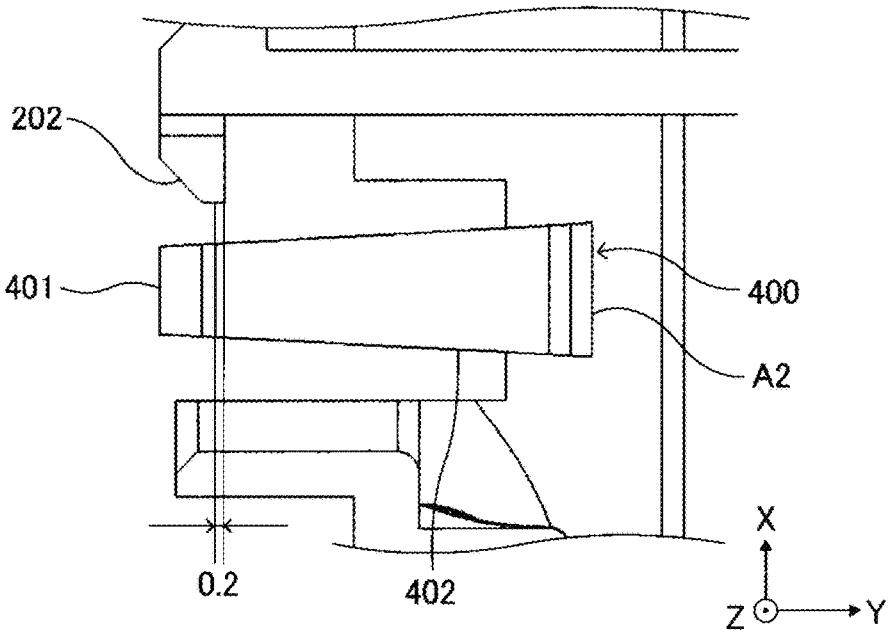
FIG. 13 is a diagram illustrating the position of the first engagement claw relative to the position of the second engagement claw in the Y direction.

FIG. 13 is a diagram illustrating the position of the first engagement claw 202 relative to the position of the second engagement claw 401 in the Y direction.

As illustrated in FIG. 13, the end portion of the first engagement claw 202 in the +Y direction is located closer toward the +Y direction, than the end portion of the second engagement claw 401 in the +Y direction. In other words, the upstream end of the first engagement claw 202 in the −Y direction (attachment direction) is located upstream from the upstream end of the second engagement claw 401 in the −Y direction. In the present embodiment, the end portion of the first engagement claw 202 in the +Y direction is located closer toward the +Y direction, than the end portion of the second engagement claw 401 in the +Y direction, by 0.2 mm. Accordingly, when attaching the guide member 130 to the sheet conveying device 100*a*, the second engagement claw 401 engages with the engagement groove 105*a* first, and the first engagement claw 202 engages with the engagement groove 105*a*.

When attaching the guide member 130 to the sheet conveying device 100*a*, the first thrust direction retainer 200 and the second thrust direction retainer 400 are elastically deformed and the first engagement claw 202 and the second engagement claw 401 climb up on the outer circumferential surface of the pickup roller shaft 105 closer to the +Y direction side from the engagement groove 105*a*. Then, the first engagement claw 202 and the second engagement claw 401 slide on the outer circumferential surface of the pickup roller shaft 105 closer to the +Y direction from the engagement groove 105*a*, so that the first engagement claw 202 and the second engagement claw 401 engage with the engagement groove 105*a*. As the first engagement claw 202 and the second engagement claw 401 engage with the engagement groove 105*a*, the sliding resistance is eliminated, and therefore the resistance generated when attaching the guide member 130 to the sheet conveying device 100*a* is drastically decreased. As a result, a click feeling is generated, so that the operator (user) feels and recognizes that the guide member 130 has been attached to the sheet conveying device 100*a*.

As described above, the rigidity of the first elastic deformation portion 204 of the first thrust direction retainer 200 is greater (stronger) than the rigidity of the second elastic deformation portion 402 of the second thrust direction retainer 400, and the first thrust direction retainer 200 is biased by the leaf spring 305 in the direction in which the first engagement claw 202 is inserted into the engagement groove 105*a* (the −X direction). Therefore, the elastic force of the first engagement claw 202 (the force to move the first engagement claw 202 from the engaging position to the releasing position) is greater (higher) than the elastic force of the second engagement claw 401, the first engagement claw 202 is hardly disengaged from the engagement groove 105*a* (the engaging force of the first engagement claw 202 is higher or greater), and the second engagement claw 401 is easily disengaged from the engagement groove 105*a* by the predetermined force in the thrust direction (the engaging force of the second engagement claw 401 is lower or smaller). According to this configuration, when attaching the guide member 130 to the sheet conveying device 100*a*, the sliding resistance of the first engagement claw 202 with respect to the pickup roller shaft 105 is greater than the sliding resistance of the second engagement claw 401 with respect to the pickup roller shaft 105. Accordingly, the click feeling generated when the first engagement claw 202 is engaged with the engagement groove 105*a* is greater than the click feeling generated when the second engagement claw 401 is engaged with the engagement groove 105*a*.

As described above, the present embodiment provides the configuration in which the end portion of the first engagement claw 202 in the +Y direction is located closer to the +Y direction than the end portion of the second engagement claw 401 in the +Y direction. By so doing, after the second engagement claw 401 has engaged with the engagement groove 105*a*, the first engagement claw 202 engages the engagement groove 105*a*. According to this configuration, the click feeling generated when the first engagement claw and the second engagement claw engage with the engagement groove is greater when compared with a configuration in which the second engagement claw 401 engages with the engagement groove 105*a* after the first engagement claw 202 has engaged with the engagement groove 105*a*. Accordingly, when compared with the configuration in which the second engagement claw 401 engages with the engagement groove 105*a* after the first engagement claw 202 has engaged with the engagement groove 105*a*, it is easier to feel that the guide member 130 is attached to the sheet conveying device 100*a*.

Figure 14:
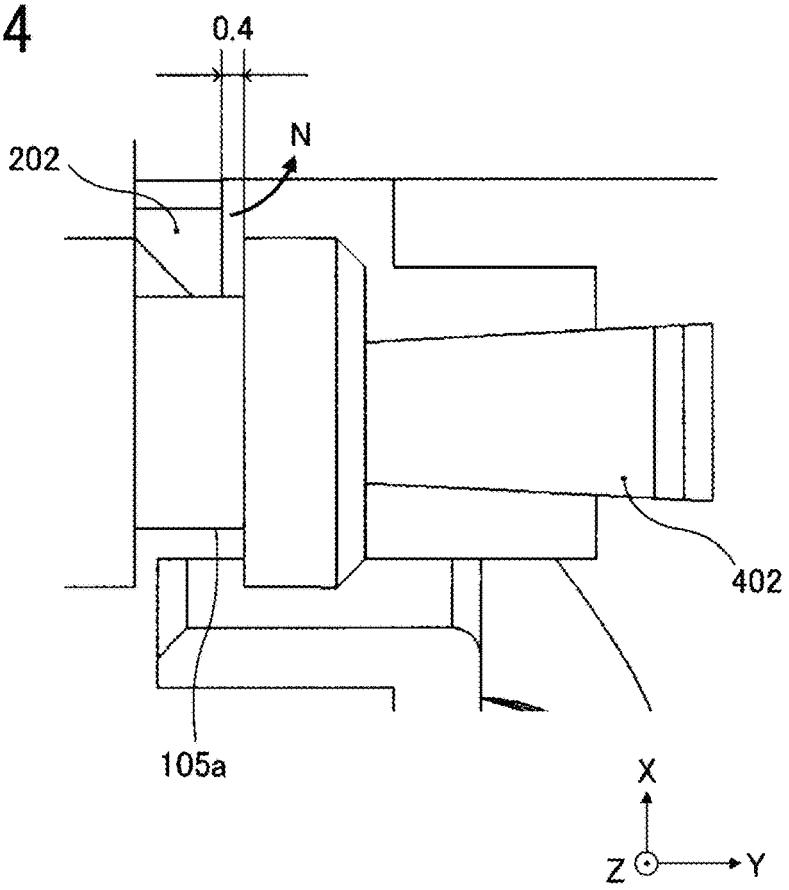
FIG. 14 is a diagram illustrating the first engagement claw relative to the engagement groove in the Y direction.

FIG. 14 is a diagram illustrating the first engagement claw 202 relative to the engagement groove 105*a* in the Y direction.

As illustrated in FIG. 14, the length of the first engagement claw 202 in the Y direction is shorter than the length of the engagement groove 105*a* in the Y direction. A predetermined gap is provided between the first engagement claw 202 and the engagement groove 105*a*. That is, the first engagement claw 202 has the predetermined gap with the engagement groove 105*a*. In the present embodiment, as illustrated in FIG. 14, the gap has the length of 0.4 mm between the first engagement claw 202 and the engagement groove 105*a*.

When the movable operation portion 201 is moved to the fixed operation portion 206 to cancel (release) the engagement of the first engagement claw 202 with the engagement groove 105*a*, the first engagement claw 202 is moved in the direction indicated by arrow N in FIG. 14. Therefore, if there is no predetermined gap between the first engagement claw 202 and the engagement groove 105*a* in the Y direction, when the first engagement claw 202 is moved from the engaging position to the releasing position, the first engagement claw 202 is caught by the end portion of the engagement groove 105*a* in the +Y direction, which hinders smooth movement of the first engagement claw 202 to the releasing position.

By contrast, in the present embodiment, since the predetermined gap is provided between the first engagement claw 202 and the engagement groove 105*a* in the Y direction, when the first engagement claw 202 is moved from the engaging position to the releasing position, the first engagement claw 202 is caught by the end portion of the engagement groove 105*a* in the +Y direction, and the first engagement claw 202 is moved to the releasing position smoothly. Accordingly, by operating the guide release operation unit 203, the engagement of the first engagement claw 202 with the engagement groove 105*a* is cancelled (released) reliably. In other words, the first engagement claw 202 is disengaged form the engagement groove 105*a* reliably.

In the present embodiment, a printable sheet is employed as an example of the form of a sheet. However, the form of a sheet is not limited to the form described in the present embodiment. Printable sheet includes pulp-based paper, postcards, and business cards, for example. The size of the sheet is not limited to a fixed size and is not particularly limited as long as the sheet has a size that is conveyable by the sheet conveying device. The form of the sheet includes, e.g., a prepreg (that is a sheet-like material in which carbon fiber or the like is previously impregnated with resin), cloth, metal sheet, and plastic film.

Furthermore, an apparatus or device to which the sheet conveying device according to the present disclosure is not limited to an image forming apparatus but may be any apparatus or device that includes a function to convey a sheet or sheets. For example, the present disclosure may be applied to a sheet inspection device that conveys a sheet and inspects the type or condition of the sheet by an inspector provided in the sheet inspection device.

The configurations according to the above-descried embodiments are not limited thereto. This disclosure can achieve the following aspects effectively.

Aspect 1

In Aspect 1, a sheet conveyance guide (for example, the guide member 130) includes a guide portion (for example, the guide portion 303*a*), a first thrust direction retainer (for example, the first thrust direction retainer 200), and a second thrust direction retainer (for example, the second thrust direction retainer 400). The guide portion is configured to guide a sheet (for example, the sheet 1). The first thrust direction retainer includes a first engagement portion (for example, the first engagement claw 202) and a guide releaser (for example, the guide release operation unit 203). The first engagement portion is configured to engage with a shaft (for example, the pickup roller shaft 105) of a sheet conveying roller (for example, the pickup roller 101) configured to convey the sheet. The guide releaser is configured to release engagement of the first engagement portion with the shaft of the sheet conveying roller. The second thrust direction retainer includes a second engagement portion (for example, the second engagement claw 401) configured to engage with the shaft of the sheet conveying roller.

The engaging force of the first engagement portion of the first thrust direction retainer (the first thrust direction retainer 200) is greater than the engaging force of the second engagement portion of the second thrust direction retainer. For example, the first thrust direction retainer (the first thrust direction retainer 200) has the configuration in which, even if the sheet conveyance guide (such as the guide member 130) is pulled in the thrust direction by the predetermined force, the engagement of the first engagement portion (such as the first engagement claw 202) with the shaft of the sheet conveying roller unless the guide releaser (the guide release operation unit 203) releases the engagement of the first engagement portion with the shaft of the sheet conveying roller. On the other hand, the second thrust direction retainer (such as the second thrust direction retainer 400) has the configuration in which, by pulling the sheet conveyance guide in the thrust direction by the predetermined force, the second engagement portion (such as the second engagement claw 401) is disengaged from the shaft of the sheet conveying roller. According to this configuration, as the guide releaser (such as the guide release operation unit 203) is pulled in the thrust direction by the predetermined force while the first engagement portion is disengaged from the shaft of the sheet conveying roller by the guide releaser (the guide release operation unit 203), the sheet conveyance guide is detached form the sheet conveying device (such as the sheet conveying device 100*a*).

According to the configuration including the second thrust direction retainer (the second thrust direction retainer 400), even if the guide releaser (such as the guide release operation unit 203) is operated unintentionally to cancel (release) the engagement of the first engagement portion (such as the first engagement claw 202) from the shaft of the sheet conveying roller, the second engagement portion (such as the second engagement claw 401) remains engaged with the shaft of the sheet conveying roller. Therefore, this configuration prevents the sheet conveyance guide (such as the guide member 130) from coming off from the shaft of the sheet conveying roller.

Note that the above-described engaging force indicates a force in the thrust direction to release the engagement of each engagement portion with the shaft.

Aspect 2

In Aspect 2 according to Aspect 1, the second thrust direction retainer (for example, the second thrust direction retainer 400) does not include a guide releaser configured to release engagement of the second engagement portion (for example, the second engagement claw 401) with the shaft (for example, the pickup roller shaft 105) of the sheet conveying roller (for example, the pickup roller 101).

According to this configuration, the second engagement portion (such as the second engagement claw 401) is unintentionally disengaged from the shaft of the sheet conveying roller. Therefore, unexpected detachment of the second engagement portion from the shaft of the sheet conveying roller is restrained.

Aspect 3

In Aspect 1 or Aspect 2, the guide releaser (for example, the guide release operation unit 203) includes a movable operation portion (for example, the movable operation portion 201) and a fixed operation portion (for example, the fixed operation portion 206) disposed facing the movable operation portion. The fixed operation portion has a contact face (the operation face) to which the user contacts by a finger and the movable operation portion has a contact face (the operation face) to which the user contacts by the finger. The contact face of the fixed operation portion and the contact face of the movable operation portion have an uneven shape.

As described in the embodiments above, when detaching the sheet conveyance guide (for example, the guide member 130) from the sheet conveying device (for example, the sheet conveying device 100*a*), the guide releaser (such as the guide release operation unit 203) is pulled in the thrust direction (the Y direction) by the predetermined force to release the engagement of the second engagement portion (for example, the second engagement claw 401) with the shaft (for example, the pickup roller shaft 105) of the sheet conveying roller.

According to Aspect 3, since the contact face of the fixed portion and the contact face of the movable portion have the uneven shape, even if the finger of the user is caught by the contact face, it is restrained that the finger of the user slides on the contact face of the fixed portion, the contact face of the movable portion, or both. Accordingly, when detaching the sheet conveyance guide (such as the guide member 130) from the sheet conveying device (such as the sheet conveying device 100*a*) by pulling the guide releaser (such as the guide release operation unit 203) in the thrust direction (the Y direction) by the predetermined force, it is restrained that the finger of the user slides on the contact face. Therefore, the sheet conveyance guide (such as the guide member 130) is detached from the sheet conveying device (such as the sheet conveying device 100*a*) reliably.

Aspect 4

In any one of Aspects 1 to 3, the first engagement portion (for example, the first engagement claw 202) is configured to engage with an engagement target portion (for example, the engagement groove 105*a*) provided on the shaft (for example, the pickup roller shaft 105) of the sheet conveying roller (for example, the pickup roller 101) with a gap in a thrust direction (for example, the Y direction) of the shaft of the sheet conveying roller.

According to this configuration, as described with reference to FIG. 14, when the first engagement portion (such as the first engagement claw 202) is moved from the engaging position to the releasing position by operating the guide releaser (for example, the guide release operation unit 203), it is restrained that the first engagement portion is caught by the end portion of the engagement target portion (such as the engagement groove 105*a*) in the thrust direction. Accordingly, by operating the guide releaser (such as the guide release operation unit 203), the first engagement portion is moved from the engaging position to the releasing position smoothly.

Aspect 5

In any one of Aspects 1 to 4, a force to move the first engagement portion (for example, the first engagement claw 202) from an engaging position at which the first engagement portion engages with the shaft (for example, the pickup roller shaft 105) of the sheet conveying roller (for example, the pickup roller 101) to a releasing position at which engagement of the first engagement portion with the shaft of the sheet conveying roller is released is greater than a force to move the second engagement portion (for example, the second engagement claw 401) from an engaging position at which the second engagement portion engages with the shaft of the sheet conveying roller to a releasing position at which engagement of the second engagement portion with the shaft of the sheet conveying roller is released.

According to this configuration, as described in the embodiments above, the engaging force of the first engagement portion (such as the first engagement claw 202) is greater than the engaging force of the second engagement portion (such as the second engagement claw 401). According to this configuration, it is difficult to cancel (release) the engagement of the first engagement portion with the engagement target portion (for example, the engagement groove 105*a*), and the sheet conveyance guide (for example, the guide member 130) remains attached to the sheet conveying device (for example, the sheet conveying device 100*a*, 100*b*) reliably when the sheet is conveyed.

On the other hand, by applying a certain amount of the force to the sheet conveyance guide (such as the guide member 130) in the thrust direction, the second engagement portion (such as the second engagement claw 401) is moved to the releasing position, so that the engagement of the second engagement portion with the engagement target portion is released to detach the sheet conveyance guide from the sheet conveying device (such as the sheet conveying device 100*a*, 100*b*).

Aspect 6

In the sheet conveyance guide (for example, the guide member 130) of Aspect 5, the first engagement portion (for example, the first engagement claw 202) and the second engagement portion (for example, the second engagement claw 401) are configured to engage with an engagement target portion (for example, the engagement groove 105*a*) provided on the shaft (for example, the pickup roller shaft 105) of the sheet conveying roller (for example, the pickup roller 101) configured to convey a sheet (for example, the sheet 1). The sheet conveyance guide (such as the guide member 130) is configured to move in a thrust direction (for example, the Y direction) of the shaft of the sheet conveying roller to be detachably attached to a sheet conveying device (for example, the sheet conveying device 100*a*, 100*b*) that includes the sheet conveying roller. An upstream end of the first engagement portion is located upstream from an upstream end of the second engagement portion in an attachment direction at which the first engagement portion and the second engagement portion engage with the engagement target portion.

As described with reference to FIG. 13, when the first engagement portion (such as the first engagement claw 202) and the second engagement portion (such as the second engagement claw 401) engage with the engagement target portion (such as the engagement groove 105*a*) to attach the sheet conveyance guide (such as the guide member 130) to the sheet conveying device (such as the sheet conveying device 100*a*, 100*b*), the first engagement portion and the second engagement portion move to the releasing position, then climb up on the shaft of the sheet conveying roller, and slide on the shaft of the sheet conveying roller. Thereafter, the first engagement portion and the second engagement portion engage with the engagement target portion (such as the engagement groove 105*a*). In Aspect 6, the second engagement portion engages with the engagement target portion (such as the engagement groove 105*a*) first, and the first engagement portion engages with the engagement target portion.

Since the force to move the first engagement portion to the releasing position is greater than the force to move the second engagement portion to the releasing position, the contact pressure of the first engagement portion to the shaft of the sheet conveying roller increases greater than the contact pressure of the second engagement portion to the shaft of the sheet conveying roller. Therefore, the sliding resistance of the first engagement portion with the shaft of the sheet conveying roller increases greater than the sliding resistance of the second engagement portion with the shaft of the sheet conveying roller. Therefore, the click feeling generated when the first engagement portion is engaged with the engagement target portion (such as the engagement groove 105*a*) increases greater than the click feeling generated when the second engagement portion is engaged with the engagement target portion (such as the engagement groove 105*a*).

Therefore, in the configuration of Aspect 6, as the first engagement portion engages with the engagement groove (such as the engagement groove 105*a*) after the second engagement portion has engaged with the engagement groove (such as the engagement groove 105*a*), the click feeling generated when engagement of each of the first engagement portion and the second engagement portion with the engagement groove (such as the engagement groove 105*a*) is completed, when compared with a configuration in which the second engagement portion engages with the engagement groove after the first engagement portion has engaged with the engagement groove. Accordingly, when compared with the configuration in which the second engagement portion engages with the engagement target portion after the first engagement portion has engaged with the engagement target portion, it is easier to feel that the sheet conveyance guide is attached to the sheet conveying device (such as the sheet conveying device 100*a*, 100*b*).

Aspect 7

In any one of Aspects 1 to 6, the first thrust direction retainer (for example, the first thrust direction retainer 200) includes a first elastic deformation portion (for example, the first elastic deformation portion 204) configured to elastically deform so that the first engagement portion (for example, the first engagement claw 202) moves from an engaging position at which the first engagement portion engages with the shaft of the sheet conveying roller to a releasing position at which engagement of the first engagement portion with the shaft of the sheet conveying roller is released, and the second thrust direction retainer (for example, the second thrust direction retainer 400) includes a second elastic deformation portion (for example, the second elastic deformation portion 402) configured to elastically deform so that the second engagement portion (for example, the second engagement claw 401) moves between an engaging position at which the second engagement portion engages with the shaft of the sheet conveying roller and a releasing position at which engagement of the second engagement portion with the shaft of the sheet conveying roller is released. The sheet conveyance guide (for example, the guide member 130) is configured to move in a thrust direction (for example, the Y direction) of the shaft of the sheet conveying roller to be detachably attached to a sheet conveying device (for example, the sheet conveying device 100*a*, 100*b*) that includes the sheet conveying roller. A fulcrum point (for example, the fulcrum A1) of elastic deformation of the first elastic deformation portion is located upstream from the first engagement portion in a detachment direction in which the sheet conveyance guide is detached from the sheet conveying device, and a fulcrum point (for example, the fulcrum A2) of elastic deformation of the second elastic deformation portion is located downstream from the second engagement portion in the detachment direction.

According to this configuration, as described with reference to FIG. 11, when the sheet conveyance guide (such as the guide member 130) is detached from the sheet conveying device while the first engagement portion is not located at the releasing position, the first engagement portion contacts the engagement target portion (such as the engagement groove 105*a*) of the shaft of the sheet conveying roller from the upstream side in the detachment direction, and receives the reaction force from the engagement target portion. Then, due to the reaction force, the first elastic deformation portion (for example, the first elastic deformation portion 204) elastically deforms at the fulcrum point (such as the fulcrum A1) as the fulcrum. At this time, the fulcrum point (such as the fulcrum A1) of elastic deformation of the first elastic deformation portion (such as the first elastic deformation portion 204) is located upstream from the first engagement portion in the detachment direction in which the sheet conveyance guide is detached from the sheet conveying device, the first elastic deformation portion (such as the first elastic deformation portion 204) elastically deforms in the direction in which the first engagement portion engages with the engagement target portion of the shaft, as illustrated in FIG. 11A. Accordingly, the engagement of the first engagement portion with the engagement target portion of the shaft of the sheet conveying roller unless the guide releaser does not release the engagement of the first engagement portion with the engagement target portion.

On the other hand, the fulcrum point (such as the fulcrum A2) of elastic deformation of the second elastic deformation portion (such as the second elastic deformation portion 402) is located downstream from the second engagement portion in the detachment direction in which the sheet conveyance guide is detached from the sheet conveying device, the second elastic deformation portion (such as the second elastic deformation portion 402) elastically deforms so that the second elastic deformation portion moved in the direction in which the engagement of the shaft of the sheet conveying roller is released when the second engagement portion receives the reaction force from the engagement target portion (such as the engagement groove 105*a*) of the shaft of the sheet conveying roller, as illustrated in FIG. 11B. Accordingly, the second engagement portion releases engagement of the sheet conveyance guide with the shaft by pulling the sheet conveyance guide in the detachment direction without operating the guide releaser (for example, the guide release operation unit 203) to cancel (release) engagement of the sheet conveyance guide.

Aspect 8.

In any one of Aspects 1 to 7, the first elastic deformation portion (for example, the first elastic deformation portion 204) has a rib (for example, the rib 205) projecting from the first elastic deformation portion (for example, the first elastic deformation portion 204) and an amount of projection of the rib decreases toward the fulcrum point (for example, the fulcrum A1) of elastic deformation of the first elastic deformation portion (such as the first elastic deformation portion 204).

According to this configuration, as described in the embodiments above, elastic deformation of the first elastic deformation portion (such as the first elastic deformation portion 204) at a fulcrum other than the fulcrum (such as the fulcrum A1) is restrained. Accordingly, when the first engagement portion contacts the engagement target portion (such as the engagement groove 105*a*) of the shaft of the sheet conveying roller and therefore receives the reaction force from the upstream side in the detachment direction, the first engagement portion is elastically deformed at the fulcrum (such as the fulcrum A1) as a fulcrum point.

Aspect 9.

In Aspect 8, a tip end of the rib (for example, the rib 205) is closer to the fulcrum point of elastic deformation of the first elastic deformation portion (for example, the first elastic deformation portion 204) from a center of the first elastic deformation portion in the detachment direction.

According to this configuration, as described in the embodiments above, when the first engagement portion contacts the engagement target portion (such as the engagement groove 105*a*) of the shaft of the sheet conveying roller from the upstream side in the detachment direction and therefore receives the reaction force from the engagement target portion, the first engagement portion (such as the first elastic deformation portion 204) is elastically deformed at the fulcrum (such as the fulcrum A1) as a fulcrum point.

Aspect 10.

In any one of Aspects 7 to 9, a rigidity of the first engagement portion (for example, the first engagement claw 202) is greater than a rigidity of the second engagement portion (for example, the second engagement claw 401).

According to this configuration, as described with reference to FIG. 12, when receiving the reaction force from the engagement target portion (for example, the engagement groove 105*a*) of the shaft of the sheet conveying roller, the first engagement portion (such as the first engagement claw 202) is restrained from elastically deforming. Accordingly, when the first engagement portion is at the engaging position, it is restrained that the engagement of the first engagement portion with the engagement target portion of the shaft of the sheet conveying roller is disengaged.

On the other hand, the second engagement portion (such as the second engagement claw 401) is elastically deformed in the direction in which the engagement of the second engagement portion with the engagement target portion (such as the engagement groove 105*a*) of the shaft of the sheet conveying roller is released when the second engagement portion receives the reaction force from the engagement target portion. Therefore, by pulling the sheet conveyance guide (for example, the guide member 130) in the detachment direction, the engagement of the second engagement portion with the engagement target portion of the shaft of the sheet conveying roller is released.

Aspect 11.

In Aspect 10, a width (for example, the width M1) of the first engagement portion (for example, the first engagement claw 202) is greater than a width (for example, the width M2) of the second engagement portion (for example, the second engagement claw 401).

According to this configuration, as described with reference to FIG. 12, the rigidity of the first engagement portion is enhanced greater than the rigidity of the second engagement portion.

Aspect 12.

In any one of Aspects 1 to 12, the first thrust direction retainer (for example, the first thrust direction retainer 200) includes a first elastic deformation portion (for example, the first elastic deformation portion 204) configured to elastically deform so that the first engagement portion (for example, the first engagement claw 202) moves from an engaging position at which the first engagement portion engages with the shaft of the sheet conveying roller to a releasing position at which engagement of the first engagement portion with the shaft of the sheet conveying roller is released. The first elastic deformation portion (such as the first elastic deformation portion 204) has a cut (for example, the notch 207) in a support portion (for example, the second support portion 302) supported by the sheet conveying device (for example, the sheet conveying device 100*a*, 100*b*) that includes the sheet conveying roller (for example, the pickup roller 101).

According to this configuration, the first elastic deformation portion (such as the first elastic deformation portion 204) is elastically deformed reliably.

Aspect 13.

In any one of Aspects 1 to 12, the first engagement portion (for example, the first engagement claw 202) and the second engagement portion (for example, the second engagement claw 401) are configured to engage with an engagement target portion (for example, the engagement groove 105*a*) provided on the shaft (for example, the pickup roller shaft 105) of the sheet conveying roller (for example, the pickup roller 101). An amount of engagement (for example, the amount of engagement H1) of the first engagement portion with the engagement target portion is same as an amount of engagement (for example, the amount of engagement H2) of the second engagement portion with the engagement target portion in a depth direction of a groove of the engagement target portion (such as the engagement groove 105*a*).

According to this configuration, as described with reference to FIG. 12, the engagement of the second engagement portion with the engagement target portion (such as the engagement groove 105*a*) is not released by the force applied to the sheet conveyance guide (for example, the guide member 130) when a user unintentionally touches the guide releaser (for example, the guide release operation unit 203).

Aspect 14.

A sheet conveying device (for example, the sheet conveying device 100*a*, 100*b*) includes the sheet conveyance guide (for example, the guide member 130) according to any one of Aspects 1 to 13, configured to guide a sheet (for example, the sheet 1), and a sheet conveying roller (for example, the pickup roller 101) configured to convey the sheet.

According to this configuration, the sheet conveyance guide (for example, the guide member 130) is detached from the sheet conveying device (such as the sheet conveying device 100*a*, 100*b*) easily by operating the guide releaser (for example, the guide release operation unit 203) and it is restrained that the sheet conveyance guide (the guide member 130) is detached from the sheet conveying device due to an unintentional operation by the guide releaser.

Aspect 15.

An image forming apparatus (for example, the image forming apparatus 10) includes the sheet conveying device according to Aspect 14 (for example, the sheet conveying device 100*a*, 100*b*) configured to convey a sheet (for example, the sheet 1), and an image forming device (for example, the image forming device 3) configured to form an image on the sheet conveyed by the sheet conveying device.

According to this configuration, the sheet conveyance guide (for example, the guide member 130) is detached from the sheet conveying device (such as the sheet conveying device 100*a*, 100*b*) easily by operating the guide releaser (for example, the guide release operation unit 203) and it is restrained that the sheet conveyance guide (the guide member 130) is detached from the sheet conveying device due to an unintentional operation by the guide releaser.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

What is claimed is:

1. A sheet conveyance guide comprising:

a guide portion configured to guide a sheet;

a first thrust direction retainer including:

a first engagement portion configured to engage with an engagement groove in a circumferential surface of a shaft of a sheet conveying roller configured to convey the sheet; and a guide releaser configured to be operated by a user to release engagement of the first engagement portion with the shaft of the sheet conveying roller; and a second thrust direction retainer including a second engagement portion configured to engage with the engagement groove of the shaft of the sheet conveying roller, wherein the first engagement portion and the second engagement portion are engaged with the engagement groove at a same end in an axial direction of the shaft, and wherein the second thrust direction retainer does not include a guide releaser configured to be operated by a user to release engagement of the second engagement portion with the shaft of the sheet conveying roller.

2. The sheet conveyance guide according to claim 1, wherein the guide releaser includes a movable operation portion and a fixed operation portion disposed facing the movable operation portion, wherein the fixed operation portion has a contact face that the user contacts by a finger and the movable operation portion has a contact face that the user contacts by the finger, and wherein each of the contact face of the fixed operation portion and the contact face of the movable operation portion has an uneven shape.

3. The sheet conveyance guide according to claim 1, wherein the first engagement portion is configured to engage with the engagement groove provided on the shaft of the sheet conveying roller with a gap in a thrust direction of the shaft of the sheet conveying roller.

4. The sheet conveyance guide according to claim 1, wherein a force to move the first engagement portion from an engaging position at which the first engagement portion engages with the shaft of the sheet conveying roller to a releasing position at which engagement of the first engagement portion with the shaft of the sheet conveying roller is released is greater than a force to move the second engagement portion from an engaging position at which the second engagement portion engages with the shaft of the sheet conveying roller to a releasing position at which engagement of the second engagement portion with the shaft of the sheet conveying roller is released.

5. The sheet conveyance guide according to claim 4, wherein the first engagement portion and the second engagement portion are configured to engage with the engagement groove provided on the shaft of the sheet conveying roller, wherein the sheet conveyance guide is configured to move in a thrust direction of the shaft of the sheet conveying roller to be detachably attached to a sheet conveying device that includes the sheet conveying roller, and wherein an upstream end of the first engagement portion is located upstream from an upstream end of the second engagement portion in an attachment direction in which the sheet conveyance guide is attached to the sheet conveying device.

6. The sheet conveyance guide according to claim 1, wherein the first thrust direction retainer includes a first elastic deformation portion configured to elastically deform so that the first engagement portion moves from an engaging position at which the first engagement portion engages with the shaft of the sheet conveying roller to a releasing position at which engagement of the first engagement portion with the shaft of the sheet conveying roller is released, wherein the second thrust direction retainer includes a second elastic deformation portion configured to elastically deform so that the second engagement portion moves between an engaging position at which the second engagement portion engages with the shaft of the sheet conveying roller and a releasing position at which engagement of the second engagement portion with the shaft of the sheet conveying roller is released, wherein the sheet conveyance guide is configured to move in a thrust direction of the shaft of the sheet conveying roller to be detachably attached to a sheet conveying device that includes the sheet conveying roller, wherein a fulcrum point of elastic deformation of the first elastic deformation portion is located upstream from the first engagement portion in a detachment direction in which the sheet conveyance guide is detached from the sheet conveying device, and wherein a fulcrum point of elastic deformation of the second elastic deformation portion is located downstream from the second engagement portion in the detachment direction.

7. The sheet conveyance guide according to claim 6, wherein the first elastic deformation portion has a rib projecting from the first elastic deformation portion, and wherein an amount of projection of the rib from the first elastic deformation portion decreases toward the fulcrum point of elastic deformation of the first elastic deformation portion.

8. The sheet conveyance guide according to claim 7, wherein a tip end of the rib is between the fulcrum point of elastic deformation of the first elastic deformation portion and a center of the first elastic deformation portion in the detachment direction.

9. The sheet conveyance guide according to claim 6, wherein a rigidity of the first engagement portion is greater than a rigidity of the second engagement portion.

10. The sheet conveyance guide according to claim 9, wherein a width of the first engagement portion is greater than a width of the second engagement portion.

11. The sheet conveyance guide according to claim 1, wherein the first thrust direction retainer includes a first elastic deformation portion configured to elastically deform so that the first engagement portion moves from an engaging position at which the first engagement portion engages with the shaft of the sheet conveying roller to a releasing position at which engagement of the first engagement portion with the shaft of the sheet conveying roller is released, and wherein the first elastic deformation portion has a cut in a support portion supported by a sheet conveying device that includes the sheet conveying roller.

12. The sheet conveyance guide according to claim 1, wherein the first engagement portion and the second engagement portion are configured to engage with the engagement groove provided on the shaft of the sheet conveying roller, and wherein an amount of engagement of the first engagement portion with the engagement groove is same as an amount of engagement of the second engagement portion with the engagement groove in a depth direction of a groove of the engagement groove.

13. A sheet conveying device comprising:

the sheet conveyance guide according to claim 1, the sheet conveyance guide configured to guide a sheet; and a sheet conveying roller configured to convey the sheet.

14. An image forming apparatus comprising:

the sheet conveying device according to claim 13, the sheet conveying device configured to convey a sheet; and an image forming device configured to form an image on the sheet conveyed by the sheet conveying device.

15. A sheet conveyance guide comprising:

a guide portion configured to guide a sheet;

a first thrust direction retainer including:

a first engagement portion configured to engage with a shaft of a sheet conveying roller configured to convey the sheet; and a guide releaser configured to be operated by a user to release engagement of the first engagement portion with the shaft of the sheet conveying roller; and a second thrust direction retainer including a second engagement portion configured to engage with the shaft of the sheet conveying roller, wherein a force to move the first engagement portion from an engaging position at which the first engagement portion engages with the shaft of the sheet conveying roller to a releasing position at which engagement of the first engagement portion with the shaft of the sheet conveying roller is released is greater than a force to move the second engagement portion from an engaging position at which the second engagement portion engages with the shaft of the sheet conveying roller to a releasing position at which engagement of the second engagement portion with the shaft of the sheet conveying roller is released, wherein the first engagement portion and the second engagement portion are configured to engage with an engagement target portion provided on the shaft of the sheet conveying roller, wherein the sheet conveyance guide is configured to move in a thrust direction of the shaft of the sheet conveying roller to be detachably attached to a sheet conveying device that includes the sheet conveying roller, and wherein an upstream end of the first engagement portion is located upstream from an upstream end of the second engagement portion in an attachment direction in which the sheet conveyance guide is attached to the sheet conveying device.

16. A sheet conveyance guide comprising:

a guide portion configured to guide a sheet;

a first thrust direction retainer including:

a first engagement portion configured to engage with a shaft of a sheet conveying roller configured to convey the sheet; and a guide releaser configured to be operated by a user to release engagement of the first engagement portion with the shaft of the sheet conveying roller; and a second thrust direction retainer including a second engagement portion configured to engage with the shaft of the sheet conveying roller, wherein the first thrust direction retainer includes a first elastic deformation portion configured to elastically deform so that the first engagement portion moves from an engaging position at which the first engagement portion engages with the shaft of the sheet conveying roller to a releasing position at which engagement of the first engagement portion with the shaft of the sheet conveying roller is released, wherein the second thrust direction retainer includes a second elastic deformation portion configured to elastically deform so that the second engagement portion moves between an engaging position at which the second engagement portion engages with the shaft of the sheet conveying roller and a releasing position at which engagement of the second engagement portion with the shaft of the sheet conveying roller is released, wherein the sheet conveyance guide is configured to move in a thrust direction of the shaft of the sheet conveying roller to be detachably attached to a sheet conveying device that includes the sheet conveying roller, wherein a fulcrum point of elastic deformation of the first elastic deformation portion is located upstream from the first engagement portion in a detachment direction in which the sheet conveyance guide is detached from the sheet conveying device, and wherein a fulcrum point of elastic deformation of the second elastic deformation portion is located downstream from the second engagement portion in the detachment direction.

* * * * *